US008733305B2

(12) United States Patent
Scheidig

(10) Patent No.: US 8,733,305 B2
(45) Date of Patent: May 27, 2014

(54) DEVICE FOR VARIABLY ADJUSTING THE CONTROL TIMES OF GAS EXCHANGE VALVES OF AN INTERNAL COMBUSTION ENGINE

(75) Inventor: Gerhard Scheidig, Oberasbach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 68 days.

(21) Appl. No.: 13/462,924

(22) Filed: May 3, 2012

(65) Prior Publication Data

US 2012/0210961 A1 Aug. 23, 2012

Related U.S. Application Data

(63) Continuation of application No. PCT/EP2010/067168, filed on Nov. 10, 2010.

(30) Foreign Application Priority Data

Nov. 27, 2009 (DE) ..... 10 2009 056 020

(51) Int. Cl.
*F01L 1/34* (2006.01)
*F01L 1/344* (2006.01)

(52) U.S. Cl.
CPC ..... *F01L 1/34409* (2013.01); *F01L 1/3442* (2013.01)
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 5,107,804 | A | 4/1992 | Becker et al. | |
| 6,186,104 | B1 | 2/2001 | Torii et al. | |
| 6,453,859 | B1 * | 9/2002 | Smith et al. | 123/90.17 |
| 7,444,971 | B2 * | 11/2008 | Suga et al. | 123/90.17 |
| 2009/0133652 | A1 | 5/2009 | Fujyoshi et al. | |
| 2010/0294387 | A1 * | 11/2010 | Scheidig et al. | 137/625.32 |
| 2012/0227693 | A1 * | 9/2012 | Scheidig | 123/90.15 |
| 2012/0266834 | A1 * | 10/2012 | Scheidig | 123/90.17 |

FOREIGN PATENT DOCUMENTS

| | | |
|---|---|---|
| DE | 19850947 | 5/2000 |
| EP | 0806550 | 11/1997 |
| EP | 1533484 | 5/2005 |
| EP | 1849967 | 10/2007 |
| EP | 2017438 | 1/2009 |
| EP | 2075421 | 7/2009 |
| GB | 2432645 | 5/2007 |
| WO | 2006119210 | 11/2006 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A camshaft adjuster for actuating cylinder valves of a combustion engine, retardation torques are imparted back to the adjuster by the camshaft when cams are running on, and advance torques are imparted back to the adjuster by the camshaft when cams are running off, supply and removal of pressure medium is controllable by a control unit, a torque mode or pump mode is selectively adjusted by the control unit, and primarily camshaft torque is used in torque mode to build pressure in the first or second partial chamber, whereas pressure build-up in the first or second partial chamber primarily occurs in the pump mode via the pump. The control unit includes a control valve with inner and outer sleeves, and an adjustment direction and the pump or torque mode is adjustable by the control valve by the relative rotational position of the inner sleeve to the outer sleeve.

9 Claims, 34 Drawing Sheets

DEVICE FOR VARIABLY ADJUSTING THE CONTROL TIMES OF GAS EXCHANGE VALVES OF AN INTERNAL COMBUSTION ENGINE

CROSS-REFERENCE TO RELATED APPLICATIONS

This application is a continuation of PCT/EP2010/067168, filed Nov. 10, 2010, which claims the benefit of German Patent Application No. 10 2009 056 020.3, which are incorporated herein by reference as if fully set forth.

FIELD OF THE INVENTION

The invention relates to a device for variably adjusting the timing of gas exchange valves of an internal combustion engine, having a hydraulic phase adjustment unit, wherein the phase adjustment unit can be placed in drive connection with a crankshaft and with a camshaft and has at least one advance chamber and at least one retardation chamber, to and from which pressure medium can be supplied and discharged via pressure medium lines, wherein a phase position of the camshaft relative to the crankshaft can be adjusted by means of a supply of pressure medium to the adjustment chambers.

BACKGROUND OF THE INVENTION

In modern internal combustion engines, devices for variably adjusting the timing of gas exchange valves are used to enable variable configuration of the phase position of a camshaft relative to a crankshaft within a defined angular range between a maximum advanced position and a maximum retarded position. For this purpose, a hydraulic phase adjustment unit of the device is integrated into a drive train via which torque is transmitted from the crankshaft to the camshaft. This drive train can be implemented for example as a belt, chain or gear drive. The phase adjustment speed and the pressure medium requirement are significant parameters of such devices. To enable the phase position to be adapted in an optimum manner to the various driving situations, high phase adjustment speeds are desirable. In the context of measures for reducing consumption, there is furthermore a demand for an ever smaller pressure medium requirement so as to enable the pressure medium pump of the internal combustion engine to be of smaller design or to enable the delivery rate to be reduced when using regulated pressure medium pumps.

A device of this type is known for example from EP 0 806 550 A1. The device comprises a vane-type phase adjustment unit with a drive input element, which is in drive connection with the crankshaft, and a drive output element, which is connected to the camshaft for conjoint rotation therewith. A plurality of pressure spaces are formed within the phase adjustment unit, wherein each of the pressure spaces is divided into two oppositely acting pressure chambers by means of a vane. The vanes are moved within the pressure spaces by means of a supply of pressure medium to or discharge of pressure medium from the pressure chambers, which brings about a change in the phase position between the drive output element and the drive input element. In this case, the pressure medium required for phase adjustment is provided by a pressure medium pump of the internal combustion engine and is directed selectively to the advance or retardation chambers by means of a control valve. The pressure medium flowing out of the phase adjustment unit is directed into a pressure medium reservoir, the oil sump of the internal combustion engine. Phase adjustment is thus accomplished by means of the system pressure provided by the pressure medium pump of the internal combustion engine.

A further device is known for example from U.S. Pat. No. 5,107,804 A. In this embodiment, the phase adjustment unit is likewise of the vane type, and a plurality of advance and retardation chambers is provided. In contrast to EP 0 806 550 A1, phase adjustment is not accomplished by supplying pressure medium to the pressure chambers by means of a pressure medium pump; instead, alternating moments acting on the camshaft are used. The alternating moments are caused by the rolling movements of the cams on the gas exchange valves, each of which is preloaded by a valve spring. In this case, the rotary motion of the camshaft is braked during the opening of the gas exchange valves and accelerated during closure. These alternating moments are transmitted to the phase adjustment unit, with the result that the vanes are periodically subjected to a force in the direction of the retardation stop and of the advance stop. As a result, pressure peaks are produced alternately in the advance chambers and the retardation chambers. If the phase position is supposed to be held constant, pressure medium is prevented from flowing out of the pressure chambers. In the case of a phase adjustment in the direction of earlier timing, pressure medium is prevented from flowing out of the advance chambers, even at times at which pressure peaks are being produced in the advance chambers. If the pressure in the retardation chambers rises owing to the alternating moments, this pressure is used to direct pressure medium out of the retardation chambers into the advance chambers, using the pressure of the pressure peak generated. Phase adjustment in the direction of later timing is accomplished in a similar way. In addition, the pressure chambers are connected to a pressure medium pump, although only to compensate for leaks from the phase adjustment unit. Phase adjustment is thus accomplished by diverting pressure medium out of the pressure chambers to be emptied into the pressure chambers to be filled, using the pressure of the pressure peak generated.

Another device is known from US 2009/0133652 A1. In this embodiment, phase adjustment in the case of small alternating moments is accomplished, in a manner similar to the device in EP 0 806 550 A1, by supplying pressure to the advance chambers or the retardation chambers by means of a pressure medium pump while simultaneously allowing pressure medium to flow out of the other pressure chambers to the oil sump of the internal combustion engine. In the case of high alternating moments, these are used, as in the device in U.S. Pat. No. 5,107,804 A, to direct the pressure medium under high pressure out of the advance chambers (retardation chambers) into the retardation chambers (advance chambers). During this process, the pressure medium expelled from the pressure chambers is fed back to a control valve, which controls the supply of pressure medium to or discharge of pressure medium from the pressure chambers. This pressure medium passes via check valves within the control valve to the inlet port, which is connected to the pressure medium pump, wherein some of the pressure medium is expelled into the pressure medium reservoir of the internal combustion engine.

EP 2 075 421 A1 discloses a valve for a camshaft adjuster. The valve comprises a valve piston which is arranged in a rotatable manner in a valve housing. Inlets and outlets for pressurized oil are arranged such that, by adjusting the valve piston, pressurized oil can be conducted to the adjustment chambers and to a locking mechanism. Here, the locking mechanism can be activated not only in an end position of the camshaft adjuster, that is to say at a stop in the retarded or advanced position, but also in an intermediate position. This permits mid-position locking, which may be expedient depending on the engine application.

DE 198 50 947 presents a device for controlling the timing of an internal combustion engine, having at least one drive means, at least one camshaft with cams, at least one hydraulically actuable adjustment unit for adjusting the angle of relative rotation between the drive means and the camshaft, at least one hydraulic fluid supply device for charging the adjustment unit, and at least one positive control unit by means of which the hydraulic charging of the adjustment unit can be influenced at least at times and/or at least in part as a function of the absolute angle of rotation of the camshaft and/or of the cams. Here, a flow connection to the adjustment chambers is shut off in a targeted manner when pressure fluctuations caused by torques arise which would be imparted back to the adjustment chambers by the camshaft when cams are running on or running off.

U.S. Pat. No. 6,186,104 B1 discloses a vane-type valve timing control device for an internal combustion engine, in which, between the pressure cells and the control valve which actuates them, there is connected a pressure distributor device which serves to suppress disturbance camshaft torques. For this purpose, for example during a retardation, the oil supply to the pressure cells is shut off when an advance torque arises. Conversely, during an advance, the oil supply to the pressure cells is shut off when a retardation torque arises. Similarly to DE 198 50 947, therefore, a return swing of the adjustment unit is suppressed due to the adjustment of opposing camshaft torques.

SUMMARY

The invention is based on the objective of providing a device for variably adjusting the timing of gas exchange valves of an internal combustion engine with a high phase adjustment speed.

The objective is met according to the invention by specifying a camshaft adjuster for a camshaft which serves to actuate cylinder valves of an internal combustion engine, wherein retardation torques in the direction of retarded cylinder valve opening times are imparted back to the camshaft adjuster by the camshaft when cams are running on, and oppositely directed advance torques in the direction of advanced cylinder valve opening times are imparted back to the camshaft adjuster by the camshaft when cams are running off, having a pressure chamber and having an adjusting means arranged in the pressure chamber, wherein the adjusting means divides the pressure chamber into a first chamber part and a second chamber part, wherein pressure medium can be supplied to the first and the second chamber part and pressure medium can be discharged from the first chamber part and second chamber part, such that the adjusting means can be moved by a pressure difference between the first chamber part and second chamber part, resulting in a rotation of the camshaft, wherein, when a relatively high pressure prevails in the first chamber part, the camshaft is rotated in the direction of advanced cylinder valve opening times, and when a relatively high pressure prevails in the second chamber part, the camshaft is rotated in the direction of retarded cylinder valve opening times, and wherein the supply and discharge of pressure medium can be controlled by means of a control device, wherein a torque mode or a pump mode can be selectively set by means of the control device, wherein in the torque mode, predominantly camshaft torques are utilized to build up pressure in the first chamber part or in the second chamber part, whereas in the pump mode, the pressure build-up in the first chamber part or in the second chamber part is realized predominantly by means of pressure medium provided by a pressure medium pump.

In the prior art, two strategies have hitherto been followed for hydraulic camshaft adjustment: firstly, a provision of pressure medium by means of a pressure medium pump, generally an oil pump of an engine oil lubricating circuit, or a utilization of camshaft torques for generating the required adjustment pressure. The first strategy is also referred to as "oil pressure actuated" (OPA) and the second is referred to as "cam torque actuated" (CTA). The invention is now based on the realization that respective advantages of OPA and CTA methods can be expediently combined with one another as a function of an operating state of the internal combustion engine. In operating states in which a high pump pressure of the pressure medium pump is provided, the pump mode, that is to say an OPA method, is expediently selected, whereas in the event of low pump pressures but high camshaft torques, the torque mode, that is to say the CTA method, is used. Here, it is self-evidently possible for an adjustment in the CTA method to be assisted by the pressure medium pump in addition to the utilization of the camshaft torques, and vice versa.

Here, the invention is not restricted to a particular design of camshaft adjuster, that is to say, for example, use may be made of a vane-type adjuster in which multiple pairs of chamber parts are formed, wherein the adjustment means is a vane which divides the chamber parts and which is for example formed in one piece from a rotor or plugged into said rotor.

The control device preferably has a control valve which is positioned centrally in the camshaft and which has a valve piston which can be guided in a valve housing, wherein the valve housing has an inner sleeve and an outer sleeve which is radially outside the inner sleeve and surrounds the latter, wherein the inner sleeve is fixed against rotational movement by a rotation prevention means, while the outer sleeve is rotatable.

In the case of a single-piece design of the valve housing and therefore a relative rotation of the valve piston, which is fixed against rotation, and of the rotatable valve housing, it is possible under some circumstances for jamming, or an impairment of the adjustment speed or accuracy, to occur during the axial adjustment of the valve piston. This possible disadvantage is now counteracted in that the valve housing is of two-piece design, with an inner sleeve which is fixed against rotation and with a rotatable outer sleeve. This concept furthermore has other advantages such as an expedient configuration of the shift sequence and an improved locking function, which will be explained in more detail further below.

It is preferable for an orifice cover to be formed on the outer side of the inner sleeve, wherein in the orifice cover there are formed first orifices, which communicate with the first chamber part A, and second orifices, which communicate with the second chamber part B, and wherein the first orifices and second orifices are opened up or closed off by the orifice cover in accordance with the rotational angle position of the inner sleeve with respect to the outer sleeve.

In this embodiment, therefore, the supply and discharge of pressure medium to and from the chamber parts is realized by means of the control valve, the inner and outer sleeve and orifices or oil ducts in the camshaft. Here, the supply and discharge of pressure medium takes place as a function of a rotational angle of the camshaft. This rotational angle corresponds in turn to the camshaft torques, such that a supply and discharge of pressure medium can be correspondingly synchronized with the respective camshaft torques as a function of the desired adjustment direction. Here, the orifice cover opens up the first or second orifices, which respectively correspond to the chamber part to be actuated, depending on the occurrence of camshaft torques and the desired adjustment direction. Here, the first and second orifices need not lie in a region formed in one piece with the rest of the camshaft; in this regard the camshaft should also be regarded as including a component, an adapter or the like, which is mounted on the camshaft and rotates therewith.

It is furthermore preferable for the first orifices and the second orifices to be arranged relative to one another on the circumference at an angular interval, in each case spaced apart uniformly, and arranged in the correct phase with respect to the orifice cover, such that a relative rotation of the valve piston with respect to the valve housing by the angular interval leads to a geometrically identical arrangement. It is furthermore preferable for the orifice cover to be designed so as to be adapted with regard to an asymmetrical displacement of camshaft torques in relation to the zero line. Such an asymmetrical displacement occurs in particular as a result of a friction torque which acts on the camshaft in the retardation direction in an angle-independent manner. In this way, the approximately sinusoidal curve of the camshaft profile is thus displaced, as a whole, by a magnitude corresponding to the friction torque. It may thus be advantageous for the respective local widths of the orifice cover to be adapted to the now shortened or lengthened effective times of an advance or retardation torque. For example, an orifice cover illustrated in a "developed" view would no longer correspond to a symmetrical rectangular waveform curve with maximum and minimum phases of equal length, but rather would have in each case different lengths for the maximum and minimum phases.

The valve piston can preferably be displaced axially by means of an electromagnet, wherein the electromagnet presses the valve piston against a restoring spring which can effect a restoring movement of the valve piston, wherein the restoring spring is supported in a mounting sleeve and wherein at the same time a mounting spring is provided which, oppositely with respect to the restoring spring, is supported at one side in the bearing sleeve and at the other side on the camshaft. It is furthermore preferable for the mounting spring to support a mounting piston which is supported in an approximately punctiform manner on a mounting pin which is connected to the camshaft. In this embodiment, it is possible in particular for a production tolerance chain to be kept small by means of the compensating mounting spring. Furthermore, low-friction mounting of the stationary valve piston relative to the rotating camshaft is attained by means of the approximately punctiform support of the bearing piston on the mounting pin.

The pump mode or the torque mode can preferably be set by means of an axial displacement of a valve piston arranged in a valve housing of the control valve. It is furthermore preferable for the valve housing to have a pump orifice by means of which the supply of pressure medium either to the first chamber part or to the second chamber part can be set such that in each case either the first chamber part or the second chamber part is pressurized, wherein the flow of pressure medium out of the first chamber part or the second chamber part can be set by means of chamber part orifices in the valve housing.

The concept is thus followed of realizing an adjustment by controlling the outflow of pressure medium. Pressure medium is supplied to the chamber parts via the pump orifice in the valve housing, wherein depending on the position of the first orifices or of the second orifices, the pump orifice corresponds to the first chamber part or second chamber part. By opening up the chamber part which is reduced in size in the desired adjustment direction, an outflow of pressure medium from said chamber part is permitted, such that the pressure medium is expelled by the pressure in the other chamber part, and the adjustment is realized.

It is preferable if, for the relative axial position of the valve piston, five switching positions can be set, wherein in a first position, the pump mode is set for an adjustment of the camshaft in the direction of retarded cylinder valve opening times, in the second, axially subsequent switching position, the torque mode is set for an adjustment of the camshaft in the direction of retarded cylinder valve opening times, in the third, axially subsequent switching position, a camshaft adjustment is blocked, in the fourth, axially subsequent switching position, the torque mode is set for an adjustment of the camshaft in the direction of advanced cylinder valve opening times, and in the fifth, axially subsequent switching position, the pump mode is set for an adjustment of the camshaft in the direction of advanced cylinder valve opening times.

These five switching positions thus generally yield adequate adjustment possibilities, in a manner adapted to the respective engine operating state. For example: whereas, when there is adequate pressure from the pressure medium pump, a retardation of the camshaft takes place in switching position one and an advance takes place in switching position five, it is possible in the case of low pressure, utilizing the camshaft torques, for a retardation to take place in switching position two and an advance to take place in switching position four. The middle position, switching position three, can be utilized for a blocking of the adjustment. The double sleeve design furthermore offers the design possibility of the switching positions being axially adjacent to one another as described above, that is to say of an advance switching position not being axially adjacent to a retardation switching position, resulting in reduced switching speeds and reduced regulating outlay.

A locking mechanism is preferably provided by means of which the camshaft adjuster is mechanically blocked in a locking position so as to be prevented from being adjusted, wherein the locking mechanism can be hydraulically unlocked by the pressure medium, and wherein a supply of pressure medium to the locking mechanism is connected such that the locking device unlocks only when the valve piston is in an axial switching position which corresponds to an adjustment in the direction of advanced cylinder valve opening times.

Locking of a camshaft adjuster is necessary in particular during a shutdown of the engine, such that during a restart, when there is still only an insufficient oil pressure in the adjuster, rattling impacting of the freely movable adjuster elements does not occur. During the shutdown of the engine, therefore, it is generally the case that an adjustment in the retardation direction and locking by means of a locking pin takes place. In a conventional embodiment, the locking pin corresponds to one of the chamber parts, such that after an adequate pressure has built up after an engine start, pressure medium from the chamber parts pushes the hydraulically unlockable locking pin back counter to a spring, and the adjuster is thereby unlocked. In the above-described concept, it is now provided that a separate supply of pressure medium to the locking device is connected such that, during a state corresponding to an adjustment in the retardation direction, no pressure medium passes via the control valve to the locking pin. It is ensured in this way that, after an engine start, the locking mechanism is not unlocked already by a pressure pulse, for example by air forced in by the incoming pressure medium. Since the base position is set retarded, the adjuster must first be unlocked when the rotational position of the camshaft is to be changed, that is to say in the event of an adjustment in the advance direction. For this purpose, the valve piston is moved axially from the basic position.

It is preferable if, during installation of the control valve in the camshaft, the inner sleeve and the outer sleeve are displaced relative to one another such that a rotationally conjoint connection between the inner sleeve and outer sleeve 105 is released. It is furthermore preferable for the rotation prevention means to engage into a cutout of the electromagnet, wherein the inner sleeve can be displaced axially relative to the outer sleeve as a result of the assembly of the electromagnet.

The above-described adjustment concept demands a defined angular position of the inner sleeve and outer sleeve relative to the camshaft, because the interaction must be synchronized with the camshaft torques occurring at fixed angular positions. This defined rotational position is now attained by means of a simplification of installation such that the inner and outer sleeve are fixed in the correct position relative to one another, and then the entire control valve is attached to the camshaft, which has likewise previously been rotated into a defined angular position. During the attachment, a positive locking action between the inner sleeve and outer sleeve is released by means of an axial displacement, such that the relative rotation between the inner sleeve and outer sleeve is made possible. This is advantageously achieved by virtue of the magnet which is used for adjusting the valve piston being flange-mounted centrally in front of the camshaft, and in so doing displacing the inner sleeve. It is furthermore possible here for a rotation prevention means, for example a pin or a lug on the inner sleeve, to engage into a corresponding cutout in the magnet, wherein said engagement advantageously takes place first, and then the magnet is fastened and in so doing, via the rotation prevention means, displaces the inner sleeve.

BRIEF DESCRIPTION OF THE DRAWINGS

Further features of the invention will emerge from the following description and from the drawings, which illustrate exemplary embodiments of the invention in simplified form. In the drawings.

DETAILED DESCRIPTION OF THE PREFERRED EMBODIMENTS

Figure 1:
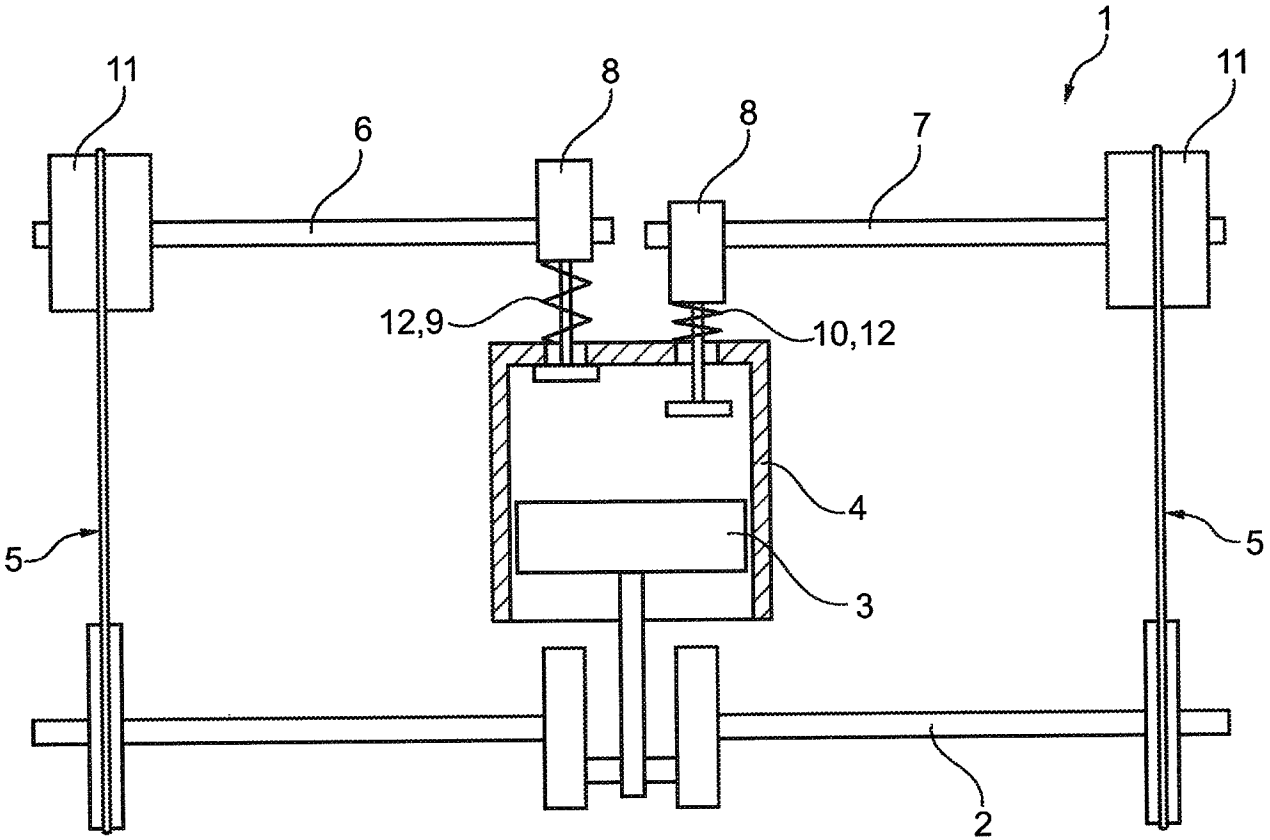
FIG. 1 shows, merely highly schematically, an internal combustion engine.

FIG. 1 illustrates an internal combustion engine 1, with a piston 3 which is connected to a crankshaft 2 being indicated in a cylinder 4. In the illustrated embodiment, the crankshaft 2 is connected via in each case one traction mechanism drive 5 to an intake camshaft 6 and an exhaust camshaft 7, wherein a first and a second camshaft adjuster 11 for variably adjusting the timing of gas exchange valves 9, 10 of an internal combustion engine can effect a relative rotation between the crankshaft 2 and the camshafts 6, 7. Cams 8 of the camshafts 6, 7 actuate one or more intake gas exchange valves 9 or one or more exhaust gas exchange valves 10. The intake gas exchange valves 9 and the exhaust gas exchange valves 10 will hereinafter be referred to for short as cylinder valves 12. It may likewise be provided that only one of the camshafts 6, 7 is equipped with a device 11, or only one camshaft 6, 7 is provided, which is equipped with a camshaft adjuster 11. The intake camshaft 6 and the exhaust camshaft 7 will hereinafter be summarized under the expression "camshaft 35".

Figure 2:
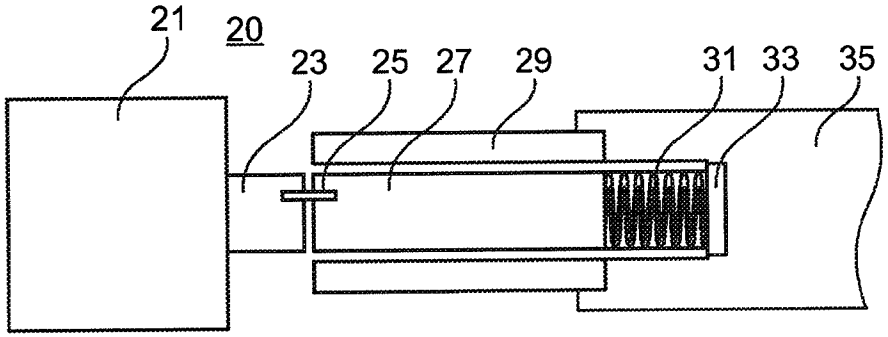
FIG. 2 is a schematic illustration of a control valve.

FIG. 2 is a schematic illustration of a control device 20. The control device 20 comprises a valve housing 29 and a valve piston 27 arranged therein. In the example shown, the control valve 20 is arranged with one end in a camshaft 35. There, the valve piston 27 is acted on by a restoring spring 31. The restoring spring 31 is mounted by means of an axial bearing arrangement 33 in the form of a rolling bearing. The valve piston 27 is connected, at its end remote from the camshaft 35, to a magnet piston 23 which can be moved axially by an electromagnet 21. A rotation prevention element 25 connects the magnet piston 23 to the valve piston 27 such that the latter cannot rotate. It is self-evidently also conceivable for an axial movement to be performed by the valve housing 29 and a rotational movement to be performed by the valve piston 27, with a correspondingly changed configuration of the surroundings.

Figure 3:
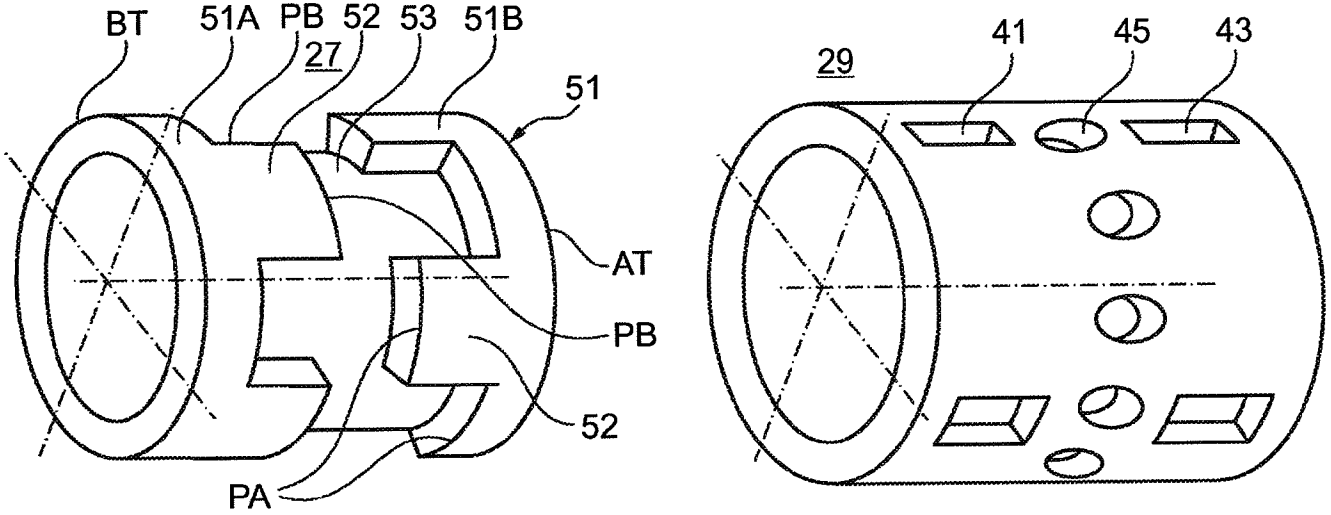
FIG. 3 shows a valve piston and a valve housing.

FIG. 3 shows the valve piston 27 and the valve housing 29 in a perspective view. The valve housing 29 has first orifices 41 distributed about its circumference. Arranged axially offset with respect to the first orifices 41 and approximately in the center of the valve housing 29 are circumferentially distributed third orifices 45. Following these with an axial offset are, in turn, second orifices 43 which are arranged at the same position in the circumferential direction as the first orifices 41. The valve piston 27 is inserted in the correct rotational position into the hollow valve housing 29. The valve piston 27 has, on its surface 53, an orifice cover 51 which is formed by a radially elevated part of the surface 53. The orifice cover has, at one axial end of the valve piston 27, a first cover part 51A, and at the opposite end, a second cover part 51B. The two cover parts 51A, 51B are of crown-like design, that is to say they form a ring around the surface 53 with a respective outer edge BT, AT. The outer edge BT of the first cover part 51A simultaneously forms one axial end of the valve piston 27, whereas the outer edge AT of the second cover part 51B simultaneously forms the other axial end of the valve piston 27. That inner edge PB, PA of the cover parts 51A, 51B which is directed axially toward the center of the surface 53 has a rectangular serration. Here, in each case one crown serration 52 of a cover part 51A, 51B is oriented in the circumferential direction so as to lie between two crown serrations 52 of the other cover part 51B, 51A, wherein there is however an axial spacing between the inner edges PB, PA.

The valve piston 27 should now be arranged in the valve housing 29 in the correct rotational position such that the orifice cover 51 opens up and blocks the first orifices 41 and second orifices 43, respectively, for the correct phase position in each case. A supply of pressure medium to chamber parts of a pressure chamber, and therefore also the adjustment of the phase position of the camshaft, is controlled in this way. This will be explained in detail further below.

Figure 4:
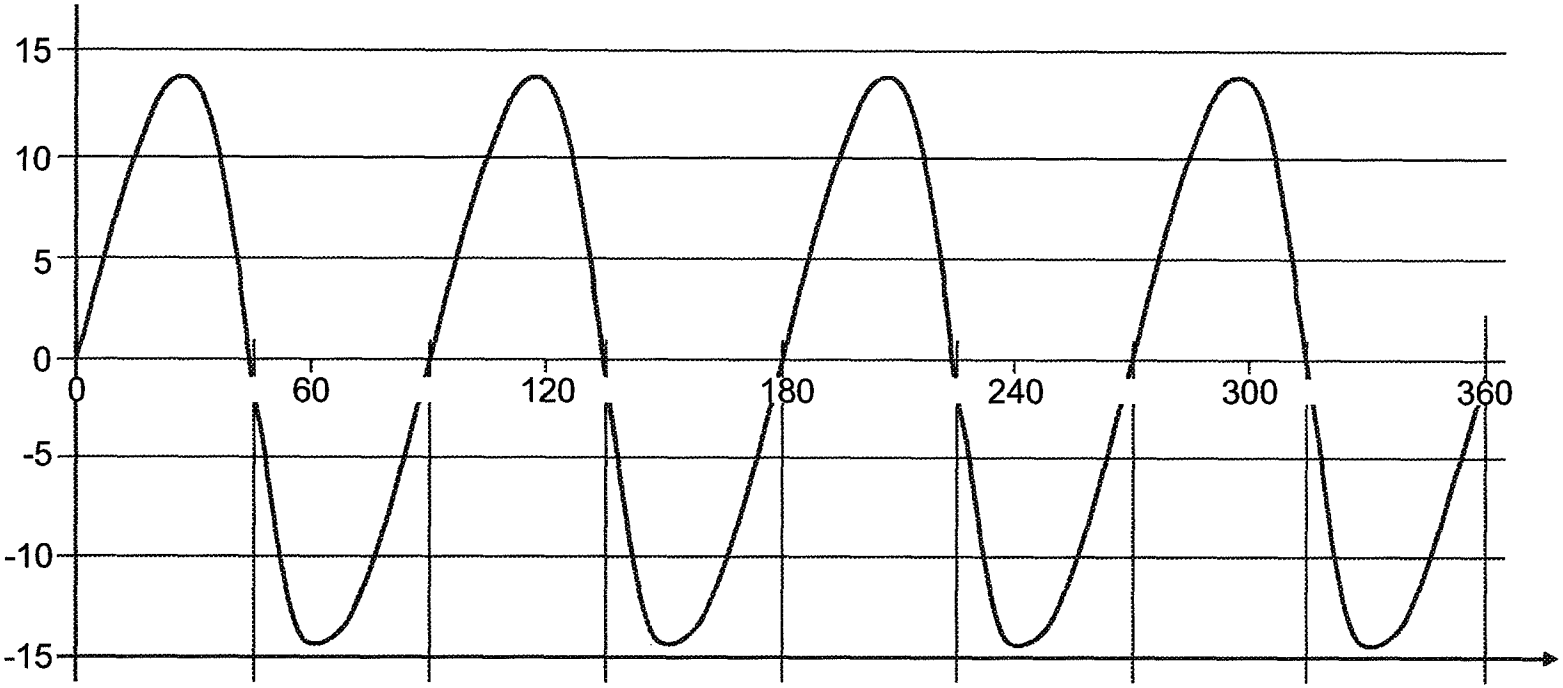
FIG. 4 is an illustration of the camshaft torques as a function of the rotational angle of the camshaft.

FIG. 4 shows, based on the example of a four-cylinder engine, the profile of the camshaft torques, plotted in the y direction, versus the rotational position of the camshaft, plotted in the x direction. A constant torque resulting from friction of the camshaft at a constant rotational speed is neglected here. Camshaft torques greater than zero correspond to a torque in the direction of an advance, that is to say in a direction which leads to earlier opening of the cylinder valves 12. Camshaft torques less than zero correspond to a torque in the direction of a retardation, that is to say in a direction which leads to later opening of the cylinder valves 12. It can be seen that the camshaft torques have an approximately sinusoidal profile as a function of the rotational position of the camshaft. At fixed angular positions in each case, advance torques arise, which alternate with retardation torques. This is now utilized in a targeted manner for the adjustment of the camshaft.

Figure 5:
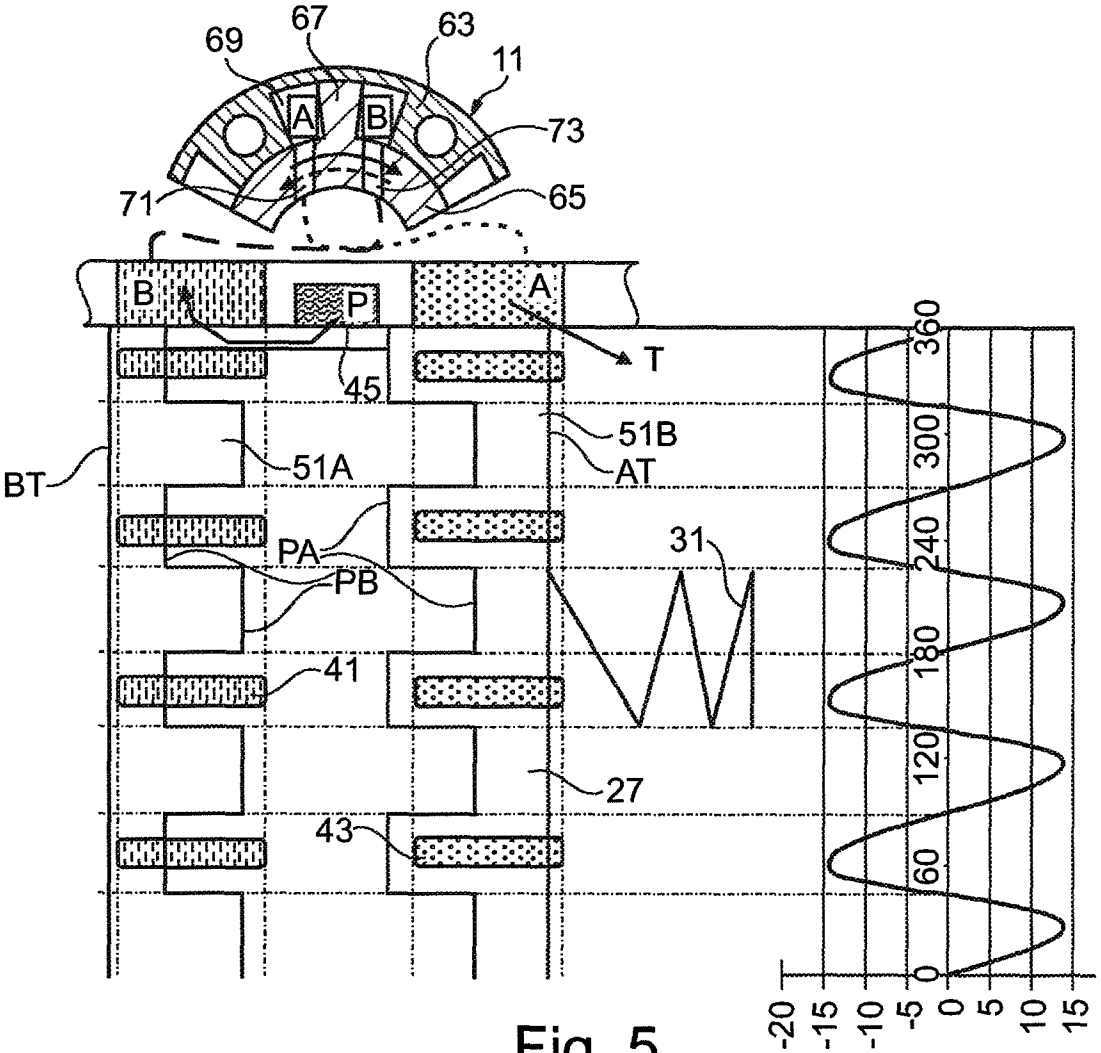
FIGS. 5-14 are schematic illustrations of the different switching positions in the case of an OPA method.

In FIG. 5, a switching position for the adjustment of the camshaft is schematically plotted such that the orifice cover 51 of the valve piston 27 is illustrated in a developed view in a plane. The first cover part 51A thus yields a rectangular profile with the inner edge PB and a straight outer edge BT. Illustrated opposite, then, is the second cover part 51B with the inner edge PA and the outer edge AT. At the outer edge AT, the valve piston 27 is connected to the restoring spring 31, which presses the valve piston 27 against a magnet 21 (not illustrated here).

Also schematically illustrated are the first orifices 41 and the second orifices 43, as they are arranged relative to the orifice cover 51 corresponding to the axial position and rotational position of the valve housing 29 relative to the valve piston 27. The first orifices 41 correspond to a second chamber part B, and the second orifices 43 correspond to a first chamber part A. The chamber parts A, B are divided by a vane 67 which forms an adjustment means 67 and which divides a pressure chamber 69 into the chamber parts A, B. The vane 67 is connected to a rotor 65 of a camshaft adjuster 11. The pressure chamber 69 is formed in a stator 63 of the camshaft adjuster 11. A first oil duct 71 leads to the first chamber part A, a second oil duct 73 leads to the second chamber part B. Only a detail of the camshaft adjuster 11 is shown here. The camshaft adjuster 11 is designed as a vane-type adjuster and has a plurality of pressure chambers, chamber parts, vanes and supply ducts, which are not illustrated here for the sake of clarity.

In the example of FIG. 5, an adjustment of the camshaft takes place in the direction of later opening times of the cylinder valves 12: pressurized oil is supplied to the second chamber part B and is discharged from the first chamber part A. In the switching position shown here, the first cover part 51 substantially opens up the first orifices 41 by means of the inner edge PB, such that pressurized oil passes from a pump P via the third orifices 45 in the valve housing 29 to the second chamber part B. At the same time, the second orifices 43 are opened up slightly by the outer edge AT of the second cover part 51B, such that oil can be discharged from the first chamber part A into a tank T. The pressure difference thus generated between the chamber parts A, B leads to a force being exerted on the vane 67 and therefore on the rotor 65 in a rotational direction to the left. The rotor 65 is connected to the camshaft 35. The camshaft 35 is thus rotated in the "retardation" direction.

As a result of the great extent to which the first orifices 41 are opened up, intense dethrottling is attained, as a result of which the risk of air induction is greatly reduced. Discharge control is realized through the lesser opening-up of the second orifices 43 to the tank.

FIG. 5 shows, on the right adjacent to the schematic illustration of the valve piston 27 and the first and second orifices 41, 43 of the valve housing, the profile, known from FIG. 4, of the camshaft torques as a function of the rotational angle of the camshaft 35. The valve housing 29 and therefore the first and second orifices 41, 43 now rotate in a defined manner relative to said camshaft profile, as shown by the juxtaposition. The first and second orifices in FIG. 5 are therefore precisely synchronous with a retardation camshaft torque. This has the effect that the second orifices 43 receive a pressure peak in the direction of a retardation, as a result of which the oil situated in the first chamber part A can be quickly discharged. Furthermore, the oil pressure of the pump P acts via the widely opened, intensely dethrottled first orifices 41 into the second chamber part B. The result is a very fast adjustment of the camshaft 35. A fast adjustment in the advance direction is also realized in a corresponding way.

Figure 6:
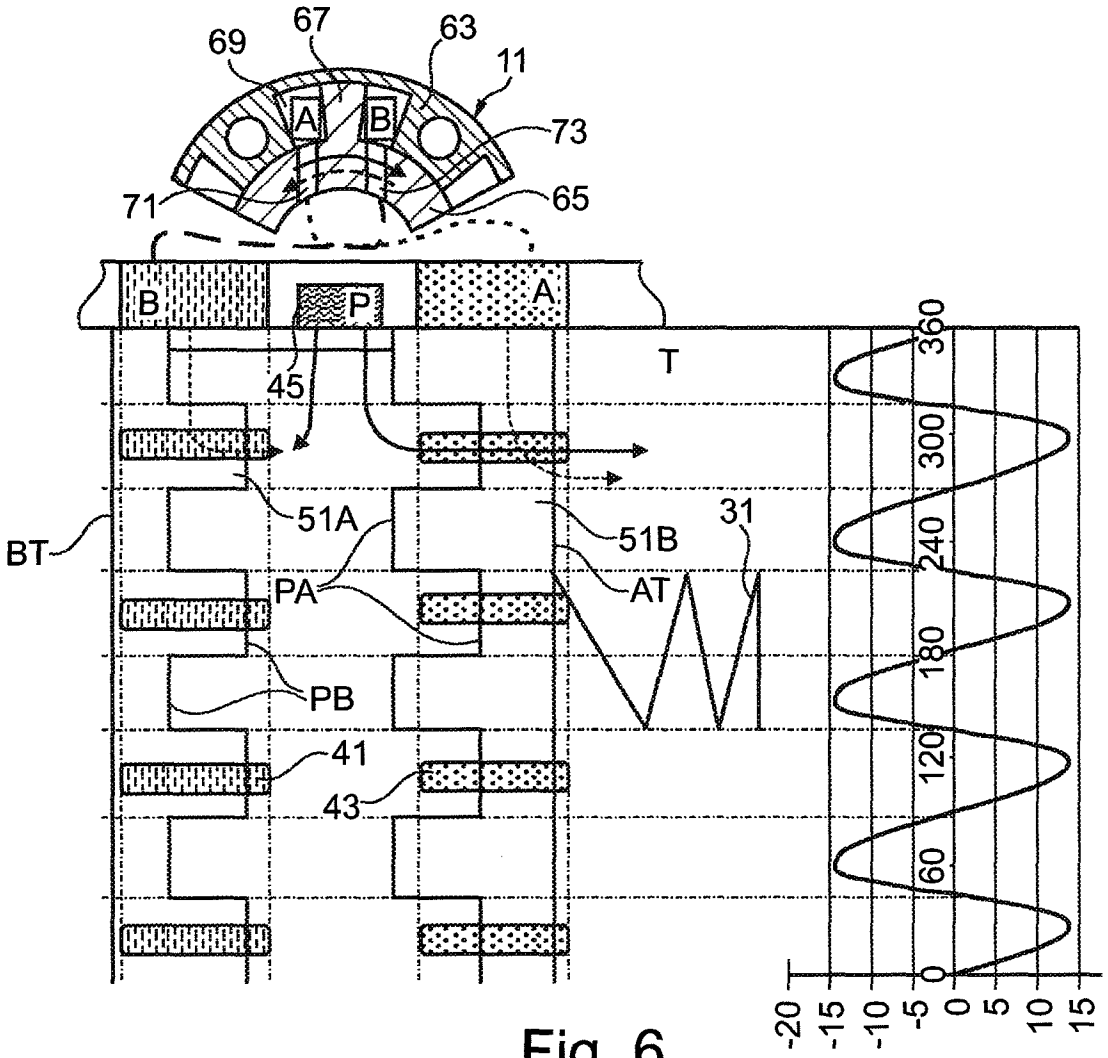

FIG. 6 shows an image corresponding to FIG. 5, but here, the first and second orifices 41, 43 have been rotated relative to the orifice cover 51. This corresponds in terms of time to the occurrence of an advance camshaft torque. The first orifices 41 are opened up only to a small extent by the first cover part 51A, whereas the second orifices 43 are opened up to a great extent for the supply of pressure from the pump P. The pump P acts on both chamber parts A, B. In chamber part B, said pump now acts counter to an advance torque, as a result of which compensation is substantially attained, and no adjustment takes place. Chamber part A is traversed by a flow of pressure medium and emptied into the tank T.

Figure 7:
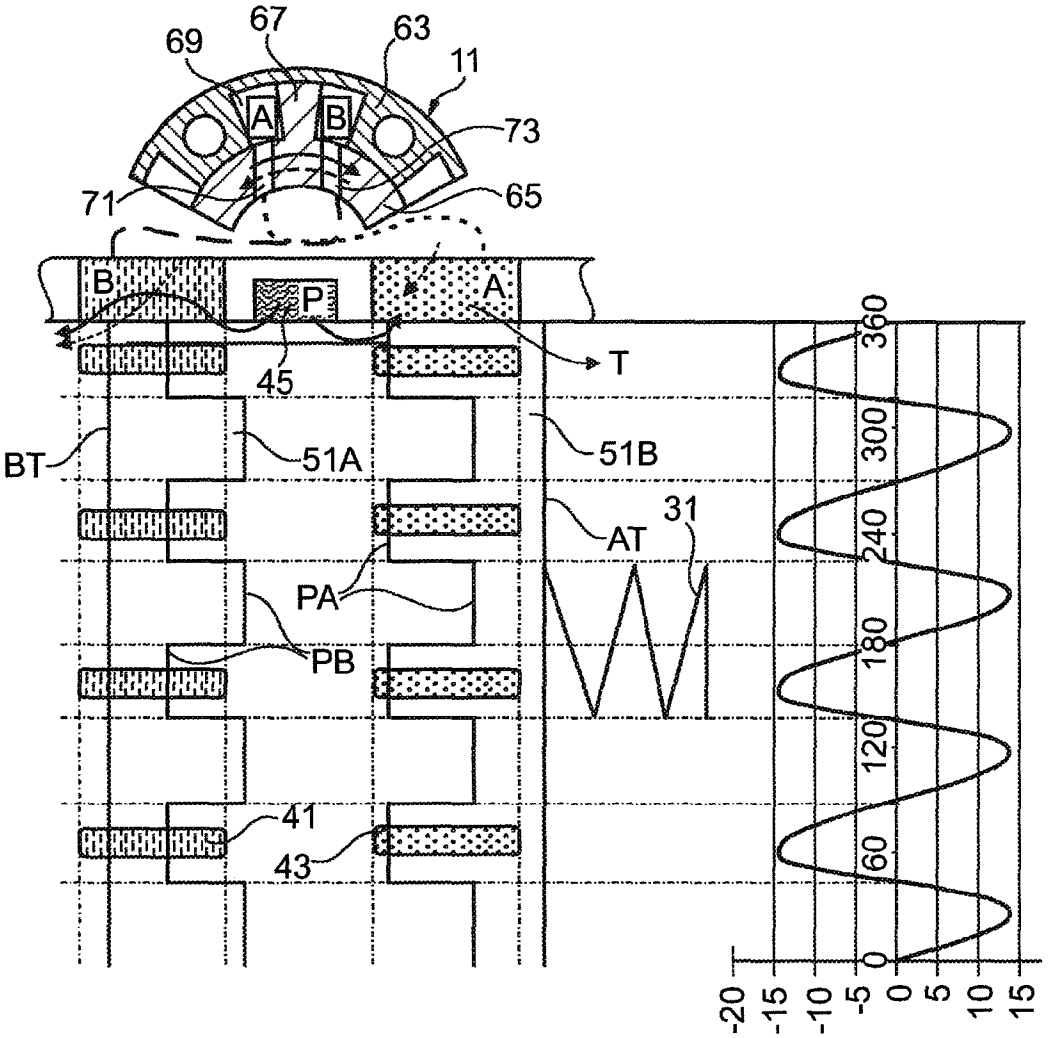
Figure 8:
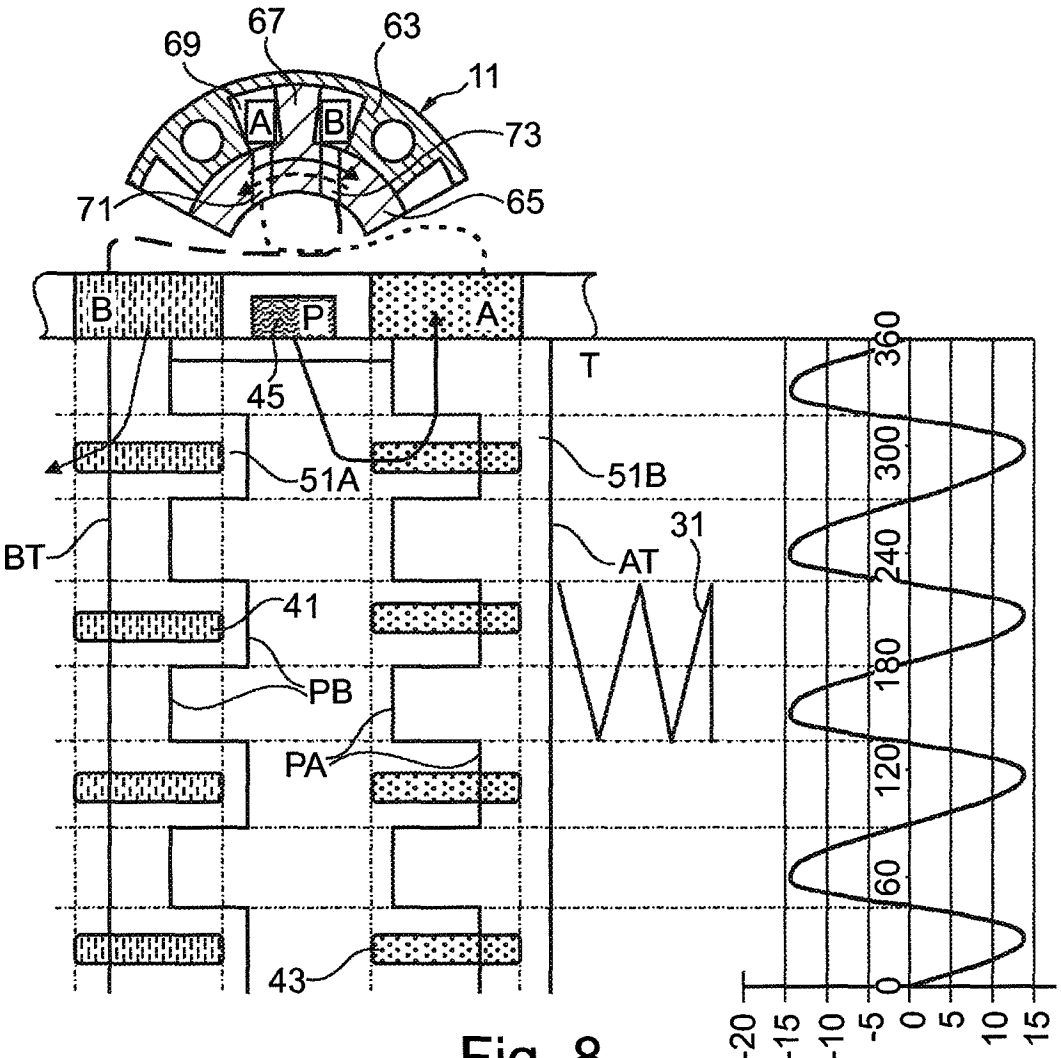

FIGS. 5 and 6 show a switching position for a "retardation" adjustment, in which an adjustment method based on the "oil pressure actuated" (OPA) principle is realized, specifically in a retardation adjustment direction. This switching position, which thus predominantly utilizes the adjustment force of the pump and in which camshaft torques have merely an assisting action, is realized by means of the illustrated axial position of the valve piston 27. The axial switching position is set by means of the magnet 21. In the example shown, this is the basic position without energization of the electromagnet 21. As explained, in the axial switching position, different rotational positions of the valve piston 27 relative to the valve housing 29 are realized, and in this way the corresponding camshaft torques are additionally utilized. FIGS. 7 and 8 show the corresponding illustration for an "advance" adjustment. Here, the actions for the chamber parts A, B are interchanged, but otherwise the explanations made with regard to FIGS. 5 and 6 apply analogously.

Figure 9:
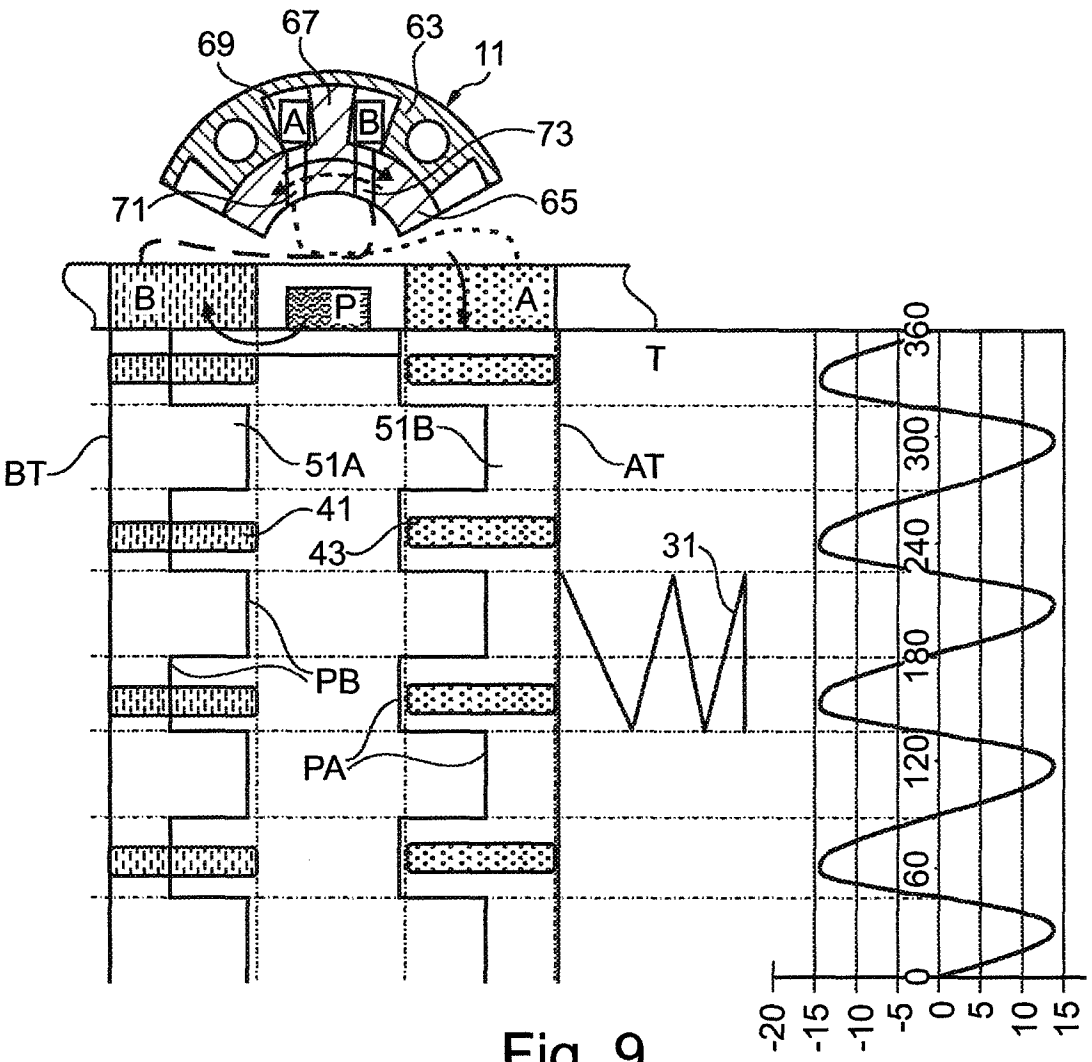

FIG. 9 shows an intermediate position in which, upon the occurrence of a retardation torque, the second orifices 43 are completely blocked. In this way, an adjustment is blocked.

Figure 10:
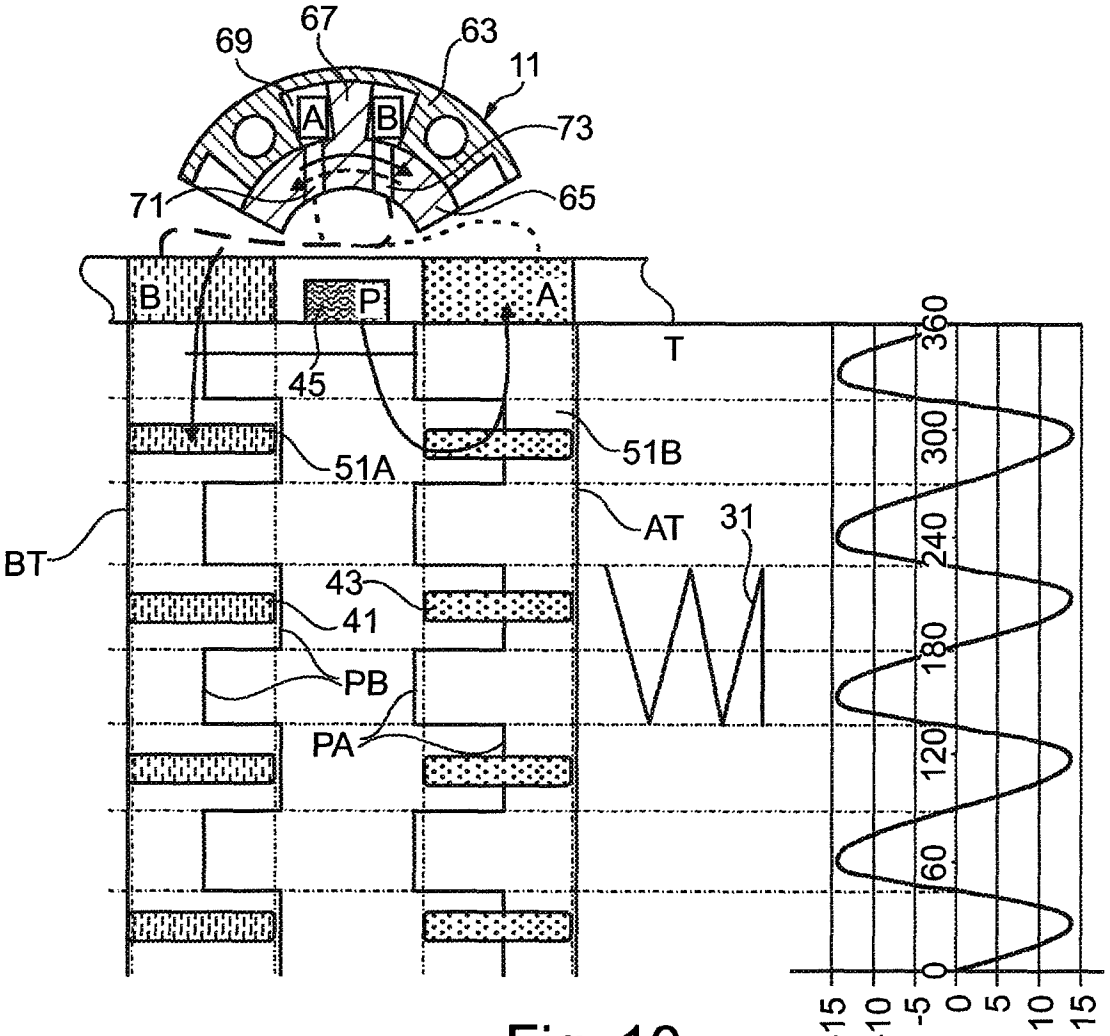

Correspondingly, FIG. 10 shows complete blocking of the first orifices 41 upon the occurrence of an advance torque. FIGS. 9 and 10 therefore depict an axial switching position of the valve piston 27 in which an adjustment of the camshaft 35 should be prevented, that is to say the camshaft should be held in a defined relative angular position with respect to the crankshaft.

FIGS. 5 to 10 show switching positions in which a high pressure of the pump P is available, that is to say generally an operating state of the internal combustion engine at high rotational speeds. If, however, the available pressure of the pump P is not high, in particular is considerably lower than the pressure exerted by camshaft torques, a suitable OPA method can be set through the selection of further switching positions. This will be described on the basis of FIGS. 11-14.

Figure 11:
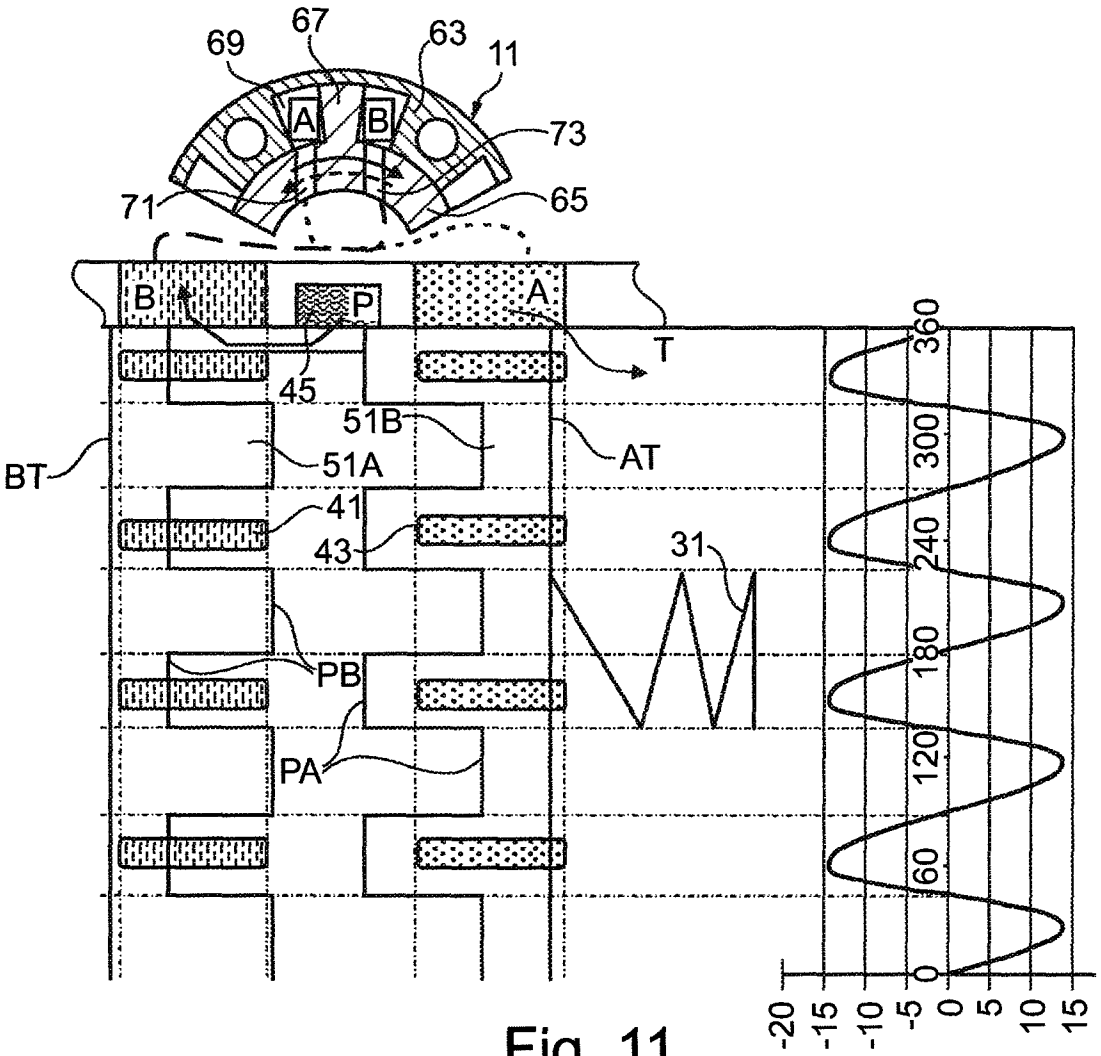
Figure 12:
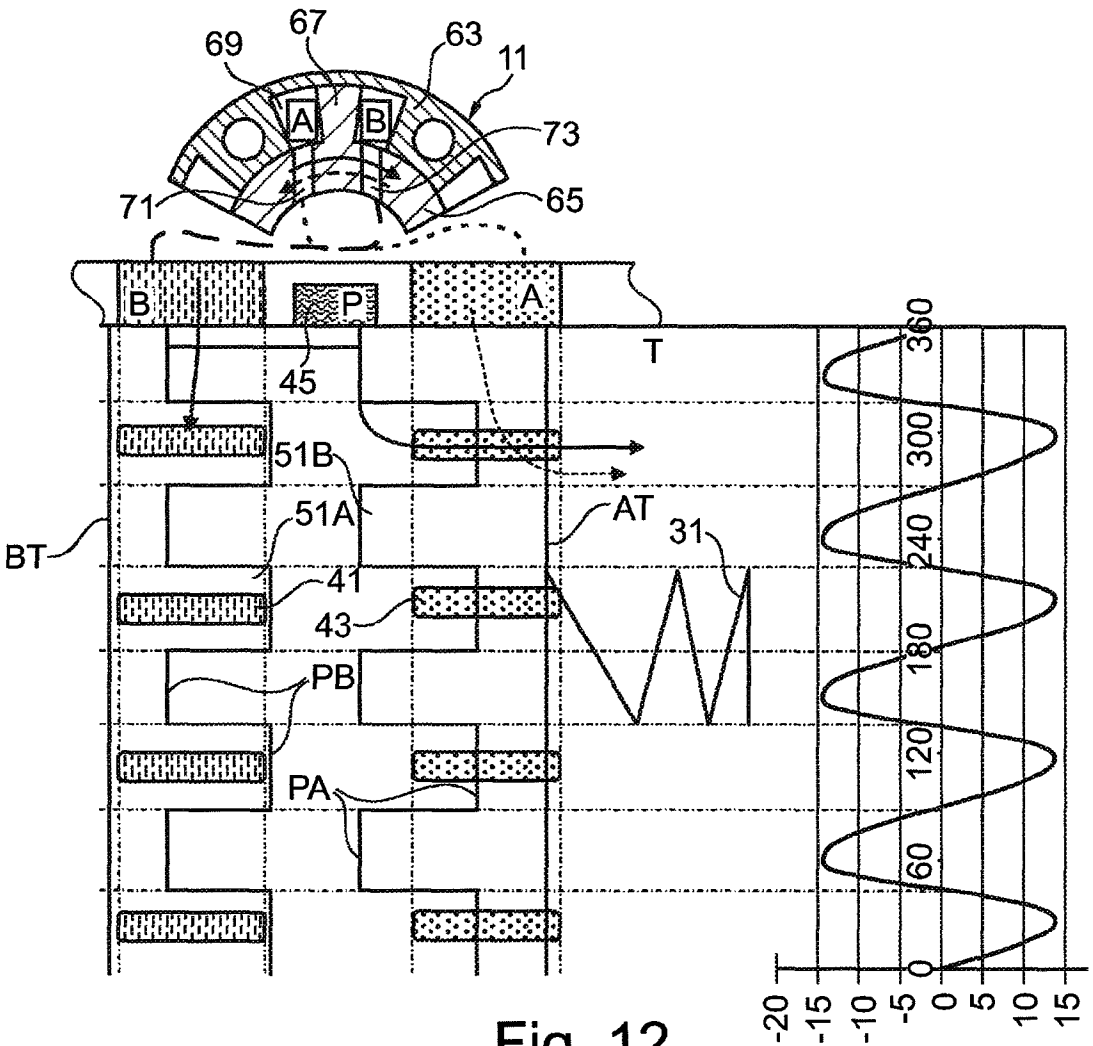

FIG. 11 corresponds to FIG. 5. It is thus sought to realize an adjustment in the "retardation" direction. Here, the retardation torque aids the adjustment. In FIG. 12, upon the occurrence of an advance torque, it is clear that, owing to the axial position of the valve piston 27 which has now changed in relation to FIG. 6, complete coverage of the first orifices 41 is attained. Whereas, therefore, in FIG. 6 only a high pump pressure was available for compensating the advance torque with the first orifices 41 slightly open, in the case of a low pump pressure the advance torque is suppressed by a complete blockage of the first orifices 41. FIGS. 13 and 14 again show the corresponding illustration in the case of an "advance" adjustment.

The switching positions illustrated above can thus be summarized as follows: two OPA adjustment methods are provided, one in the case of low pump pressure and one in the case of high pump pressure. The axial switching positions can be abbreviated as follows:

Switching position I: high pump pressure, retardation adjustment, FIGS. 5, 6

Switching position II: low pump pressure, retardation adjustment, FIGS. 11, 12

Switching position III: blocked adjustment, FIGS. 9, 10

Figure 13:
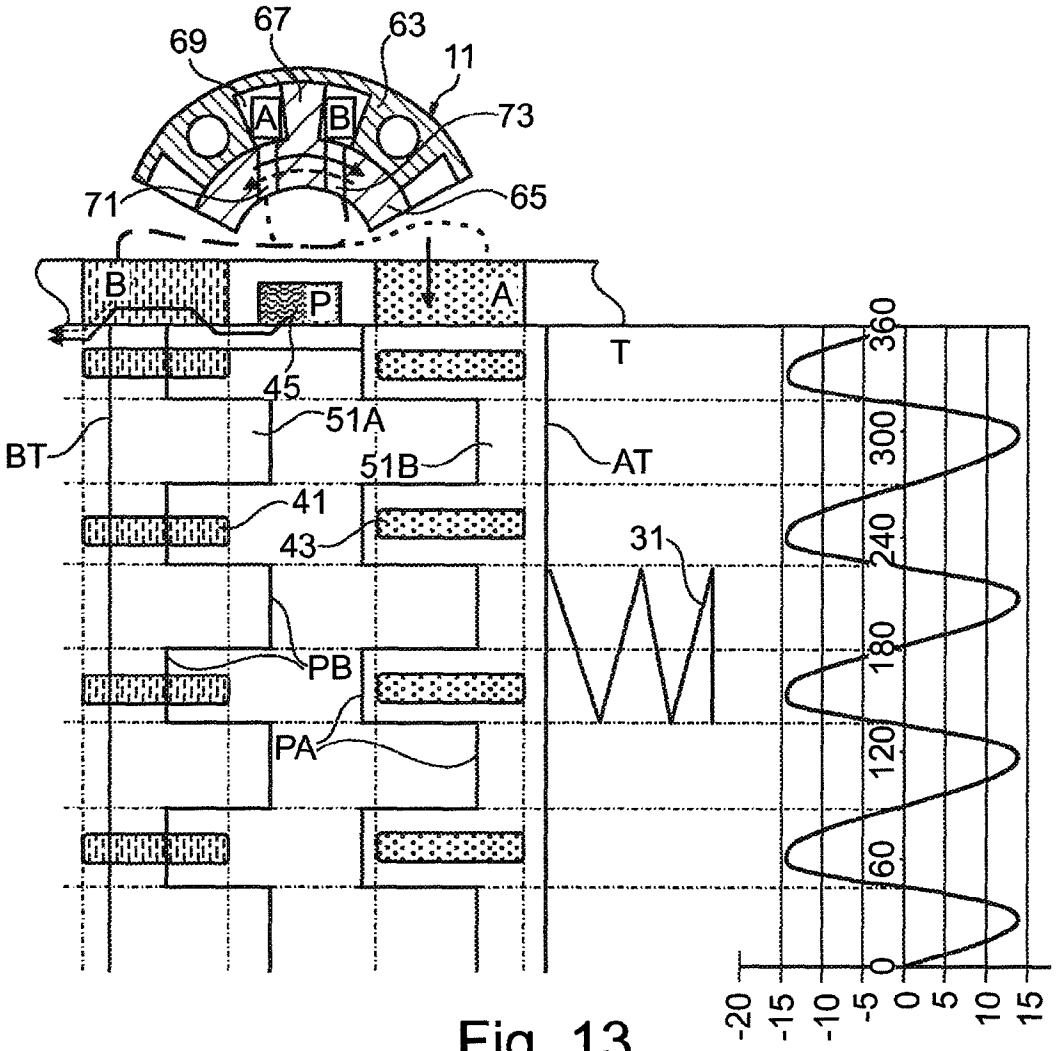
Figure 14:
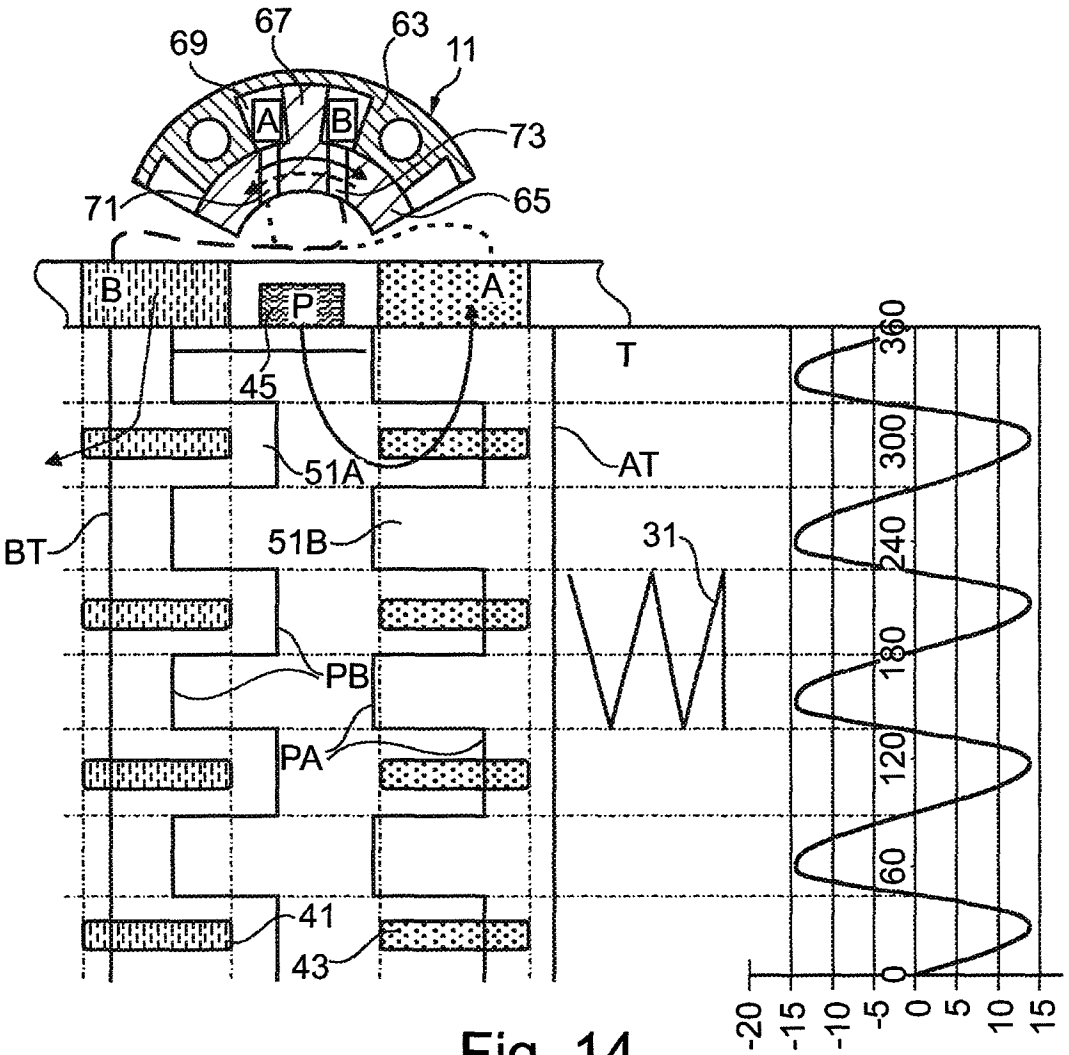

Switching position IV: low pump pressure, advance adjustment, FIGS. 13, 14

Switching position V: high pump pressure, advance adjustment, FIGS. 7, 8

The advantage of said adjustability lies in particular in the fact that, by means thereof, in the case of high pump pressure and a torque which counteracts the desired adjustment direction, the inflow openings 41 and 43 to the respective chamber parts A, B are not fully closed, as a result of which the pump power, which is higher than the relatively low camshaft torque, can nevertheless still be utilized for adjustment despite the oppositely acting camshaft torque. The times at which oppositely acting camshaft torques arise can thus be utilized for the adjustment, resulting in a fast adjustment. If, however, the pump power is lower than the camshaft torques, the oppositely acting torques are suppressed by means of the completely closed orifices 41 and 43, such that no reverse adjustment takes place.

Figure 15:
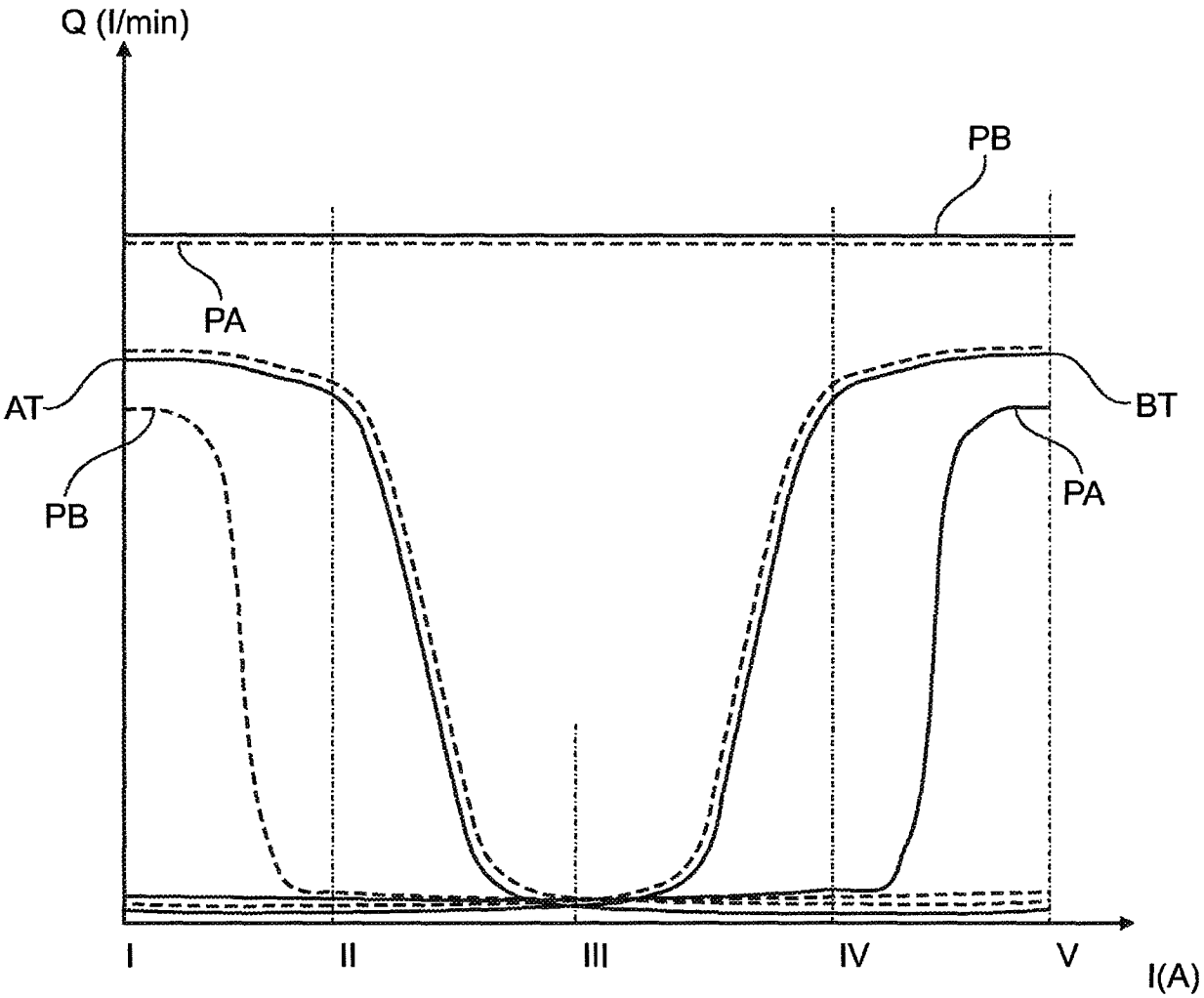
FIG. 15 is an illustration of the change in flow rates at different control edges as a function of the switching position in the OPA method.

FIG. 15 illustrates how the throughflow of pressure medium at the respective inner and outer edges PA, PB, BT, AT changes as a function of the switching position. Here, dashed lines illustrate profiles at times with a camshaft torque in the advance direction, and solid lines illustrate profiles at times with camshaft torques in the retardation direction. The line for the inner edge of the first cover part 51A, PB, will be explained by way of example: In the case of camshaft torques in the retardation direction, the throughflow at the inner edge PB is high in all axial positions, whereas in the case of torques in the advance direction, from switching position I to switching position II and subsequent switching positions, said throughflow falls quickly to zero.

Figure 16:
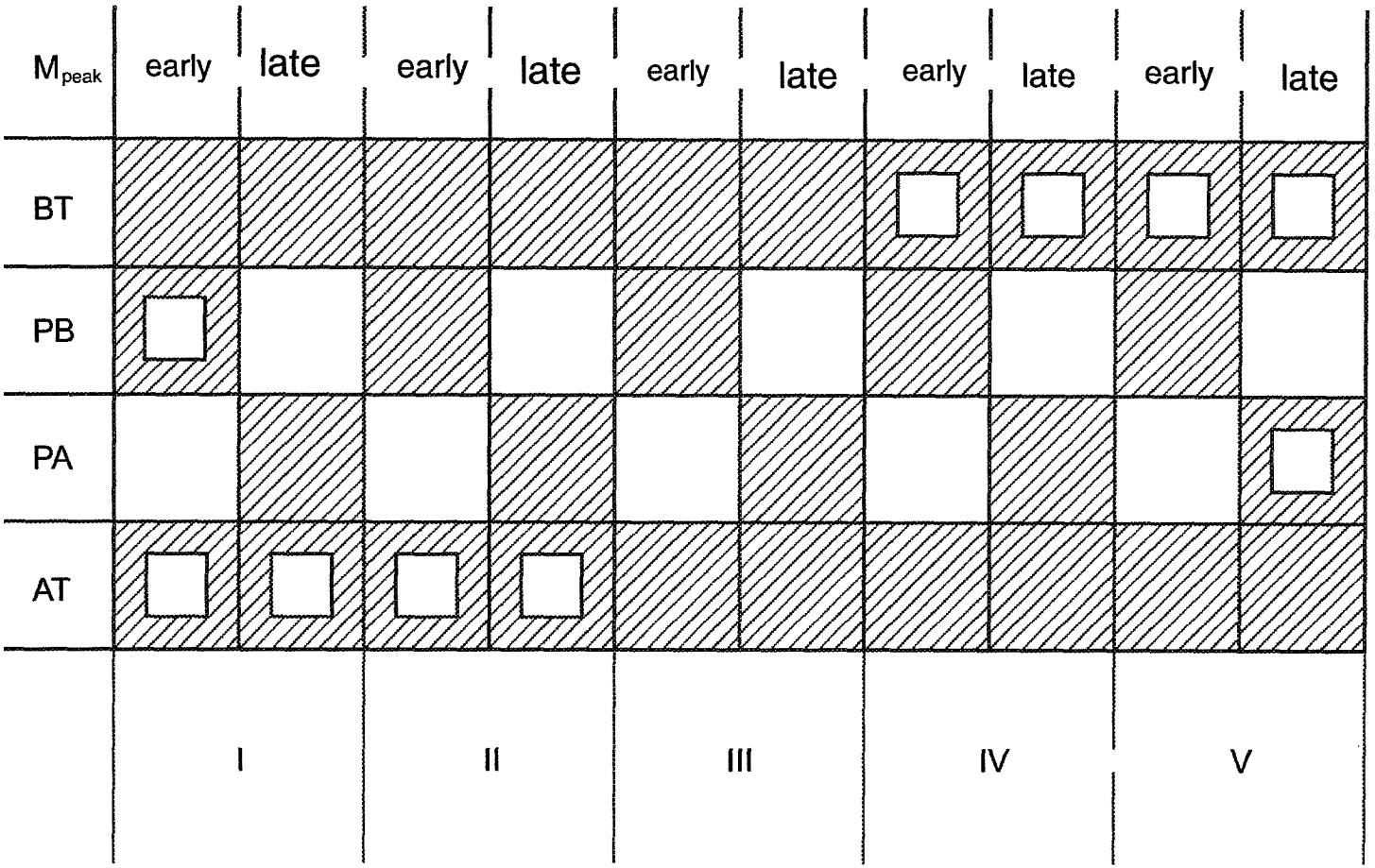
FIG. 16 is an illustration of the opening of the control edges as a function of the switching position in the OPA method.

FIG. 16 schematically shows, for switching positions I-V, the degree of opening of the orifices 41, 43 as viewed from the respective inner edges PB, PA and outer edges BT, AT as a function of the switching positions I-V and the adjusting direction. Fully hatched fields correspond to a completely blocked orifice 41, 43, fully white fields correspond to a completely open orifice 41, 43, and partially hatched fields correspond to a partially blocked orifice 41, 43.

The statements made up to this point relate to an adjustment method in which adjustment is carried out predominantly by means of the pressure provided by the pump P and in which pressure generated by camshaft torques has an assisting action in suitable switching positions. It is now sought below to describe, in addition to a pump mode of said type, a torque mode in which predominantly the pressure peaks generated by camshaft torques are utilized for adjustment, while the pressure provided by the pump P possibly assists the adjustment.

Figure 17:
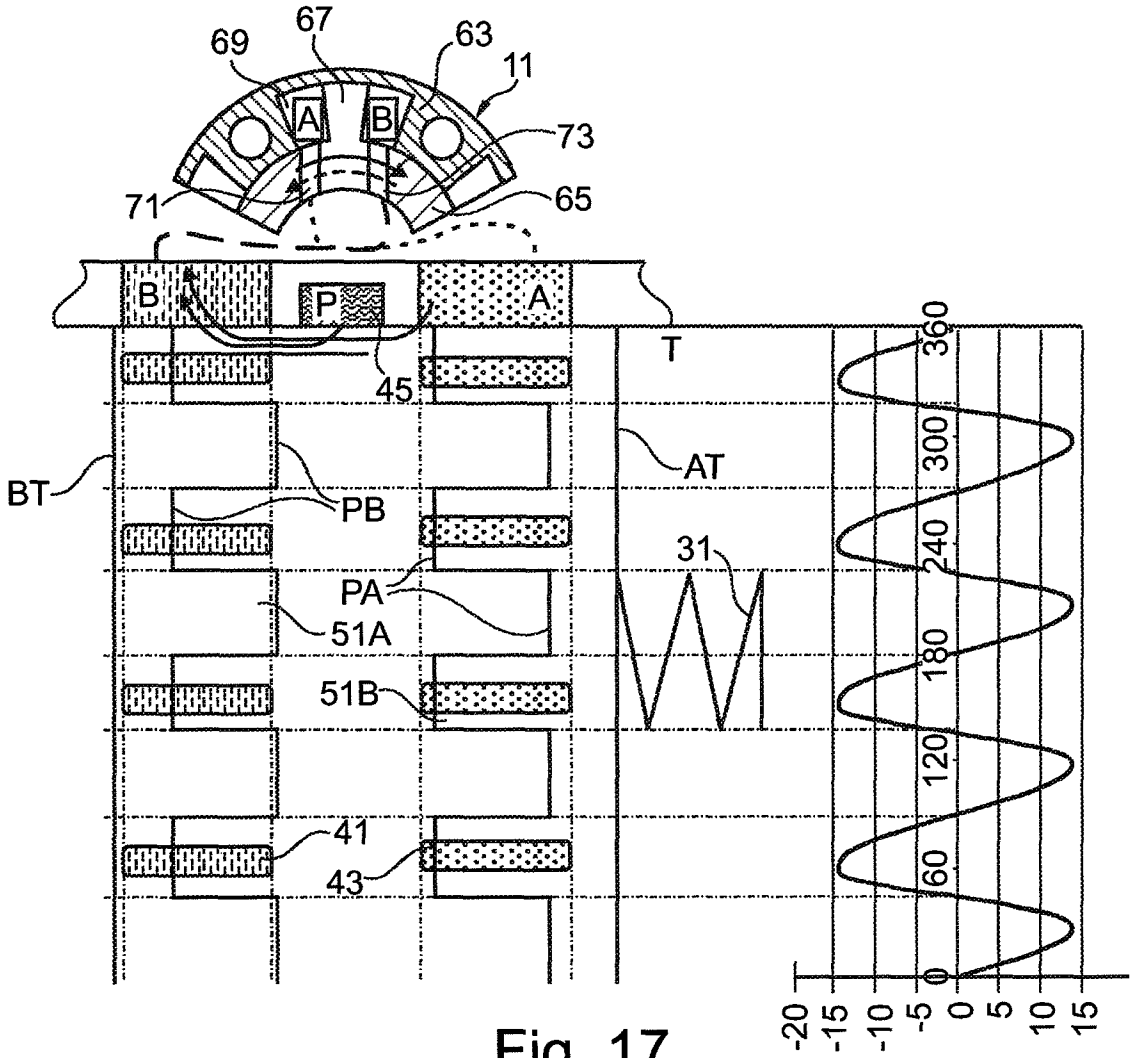
FIGS. 17-20 are schematic illustrations of the different switching positions in the case of a CTA method.

FIG. 17 shows an illustration corresponding to the illustrations of FIGS. 5-14, for the purpose of explaining a retardation adjustment by means of the utilization of the retardation torques. Here, the orifice cover 51 is set by means of the axial position of the valve piston 27 such that, upon the occurrence of a retardation torque, a connection of the two chamber parts A and B is created via the first and second orifices 41, 43. Here, the first orifices 41 are opened to a great extent, such that intense dethrottling, and therefore a low risk of air induction, are again attained. The second orifices 43 are opened to a small extent in order to realize discharge control from the first chamber part A. As a result of the camshaft torque which causes rotation in the retardation direction, a pressure peak is now built up which, by means of the different opening ratios of the first and second orifices 41, 43, generates a higher pressure in the first chamber part A than in the second chamber part B, and therefore, with a displacement of oil from the first chamber part A into the second chamber part B, causes a displacement of the vane 67 and therefore an adjustment of the camshaft 35 in the retardation direction. Oil from the pump P which arrives via the third orifices 45 assists said adjustment and compensates for leakage losses.

Figure 18:
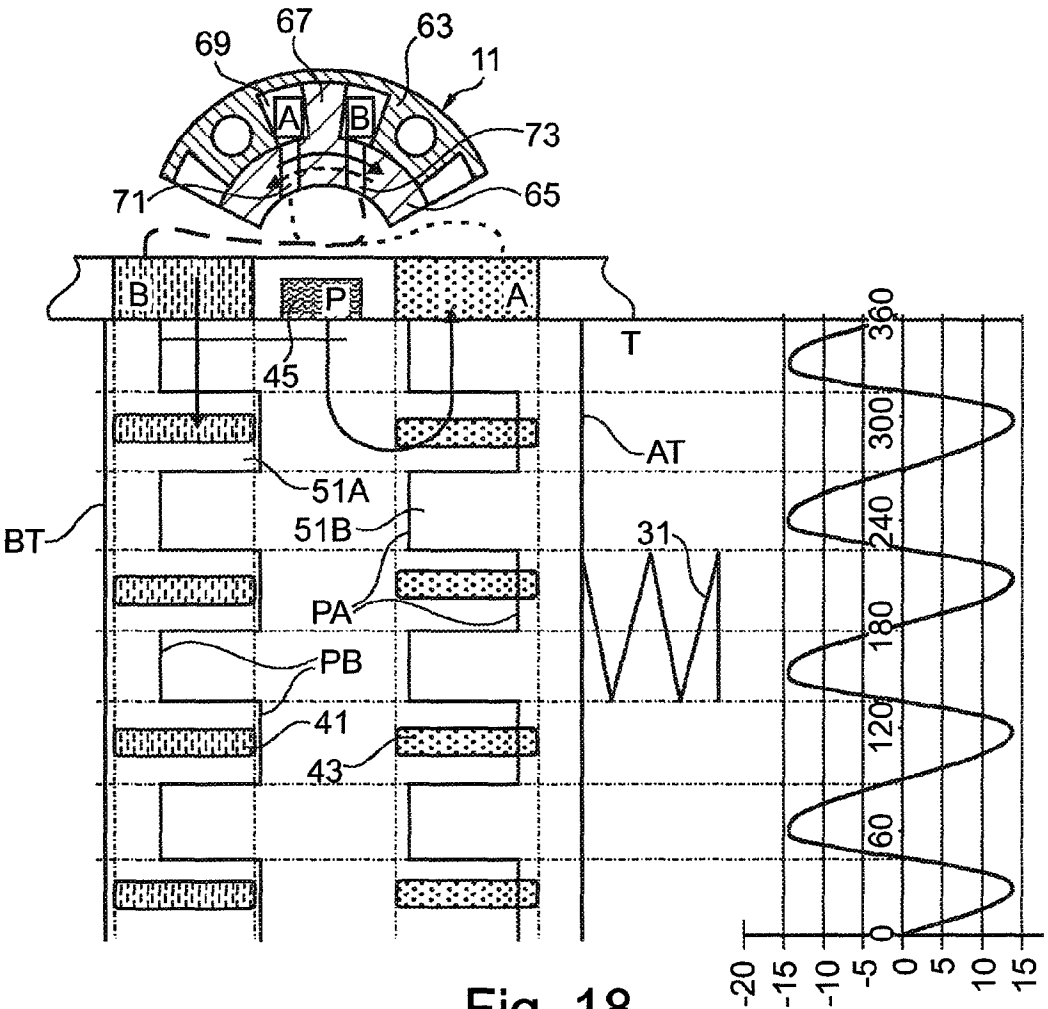

FIG. 18 shows the same axial switching position as FIG. 17, but here, the relative rotational position between the valve piston 27 and valve housing 29 has been changed, because now the camshaft 35 is in a rotational position in which an advance torque arises. Since it is still sought to realize a retardation adjustment (unchanged axial position of the valve piston 27), said advance torque must be suppressed with regard to its adjustment action. For this purpose, the first cover part 51A completely blocks the first orifices 41. Oil therefore cannot escape from the second chamber part B, and no adjustment takes place. The complete shut-off prevents a return swing. Via fully open second orifices 43, and therefore in an intensely dethrottled manner, the pump P pumps oil in an adjustment-neutral manner into the first chamber part A. Induction of air is prevented in this way.

Figure 19:
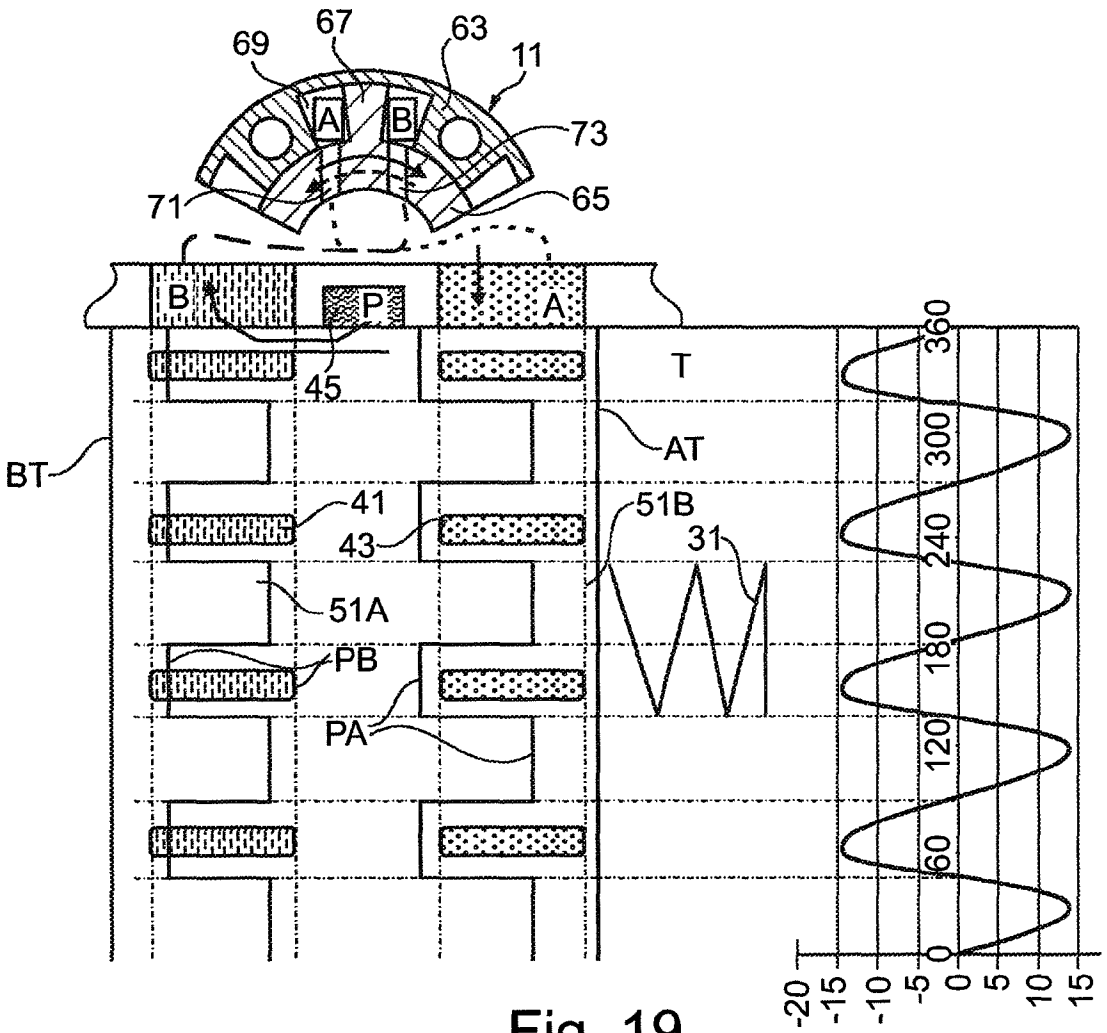
Figure 20:
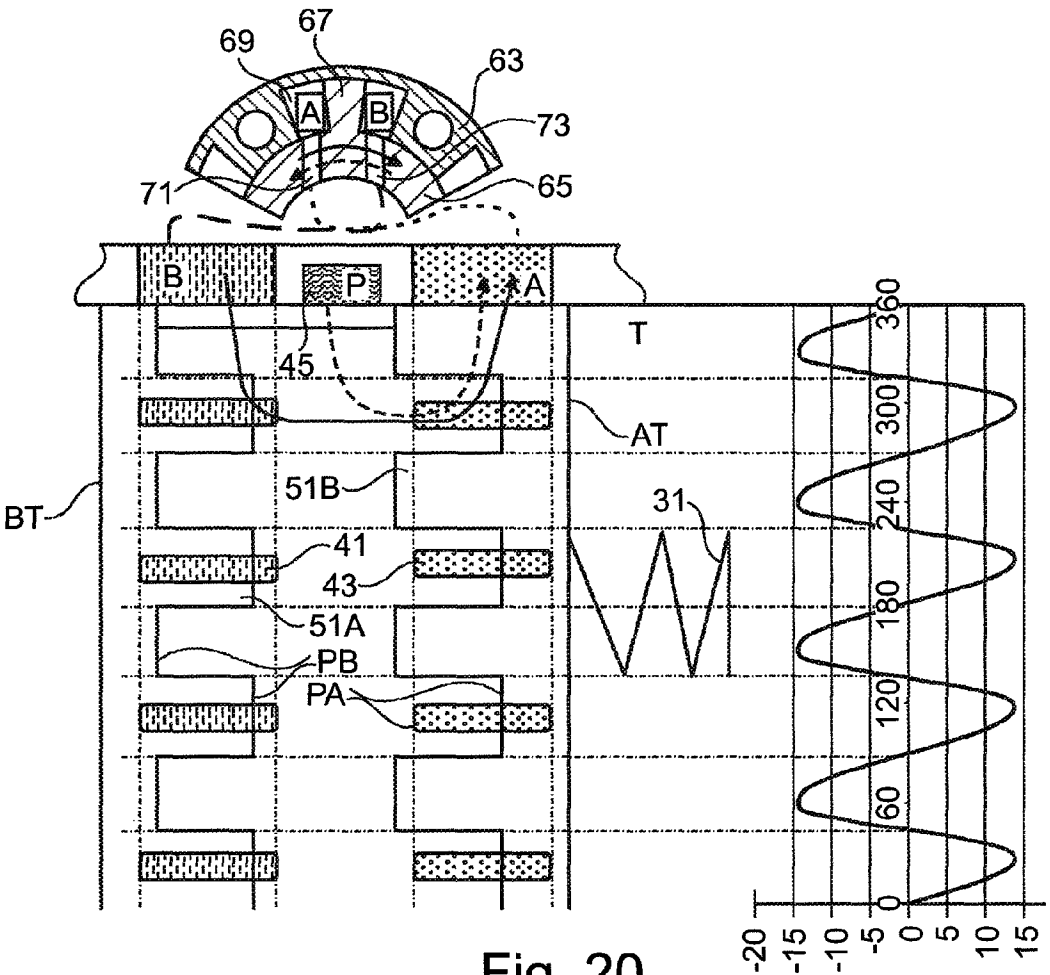

FIGS. 19 and 20 show positions corresponding to FIGS. 18 and 19, but for the opposite advance adjustment direction.

A particularly expedient sequence of switching positions can now be established by selecting axially successive switching positions as follows:

Switching position I: pump mode (OPA), retardation adjustment, FIGS. 5, 6

Switching position II: torque mode (CTA), advance adjustment, FIGS. 19, 20

Switching position III: blocked adjustment, FIGS. 9, 10

Switching position IV: torque mode (CTA), retardation adjustment, FIGS. 17, 18

Figure 21:
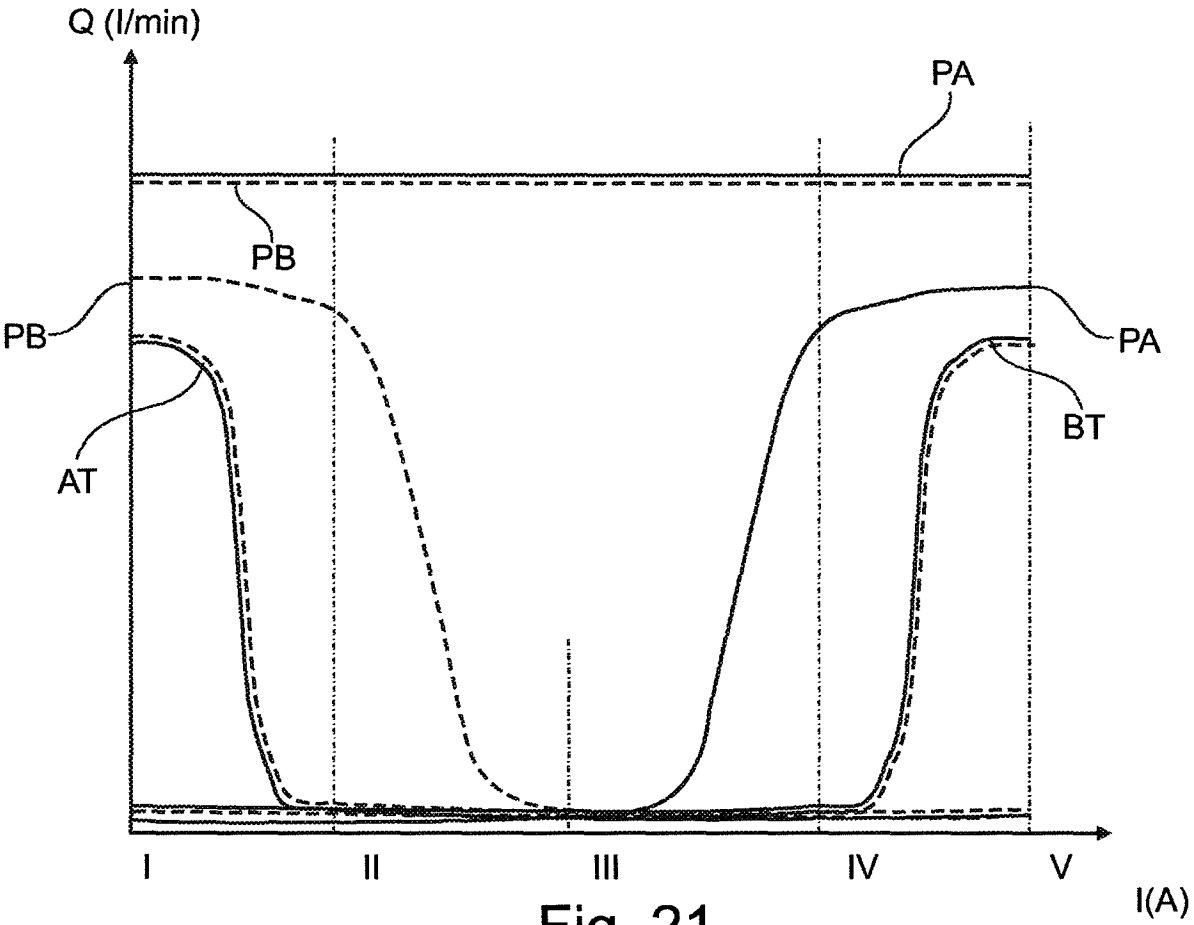
FIG. 21 is an illustration of the change in the flow rates at different control edges as a function of the switching position in the CTA method.

Switching position V: pump mode (OPA), advance adjustment, FIGS. 7,

It is therefore possible, depending on the presence either of a dominating pressure of the pump P or of dominating camshaft torques for the camshaft adjustment, to set either a pump mode or a torque mode. FIG. 21 again illustrates, for said sequence of switching positions, how the throughflow of pressure medium at the respective control edges, that is to say inner and outer edges PA, PB, AT, BT varies as a function of the axial position of the valve piston 27 and of the valve housing 29, that is to say the switching positions I-V.

Figure 22:
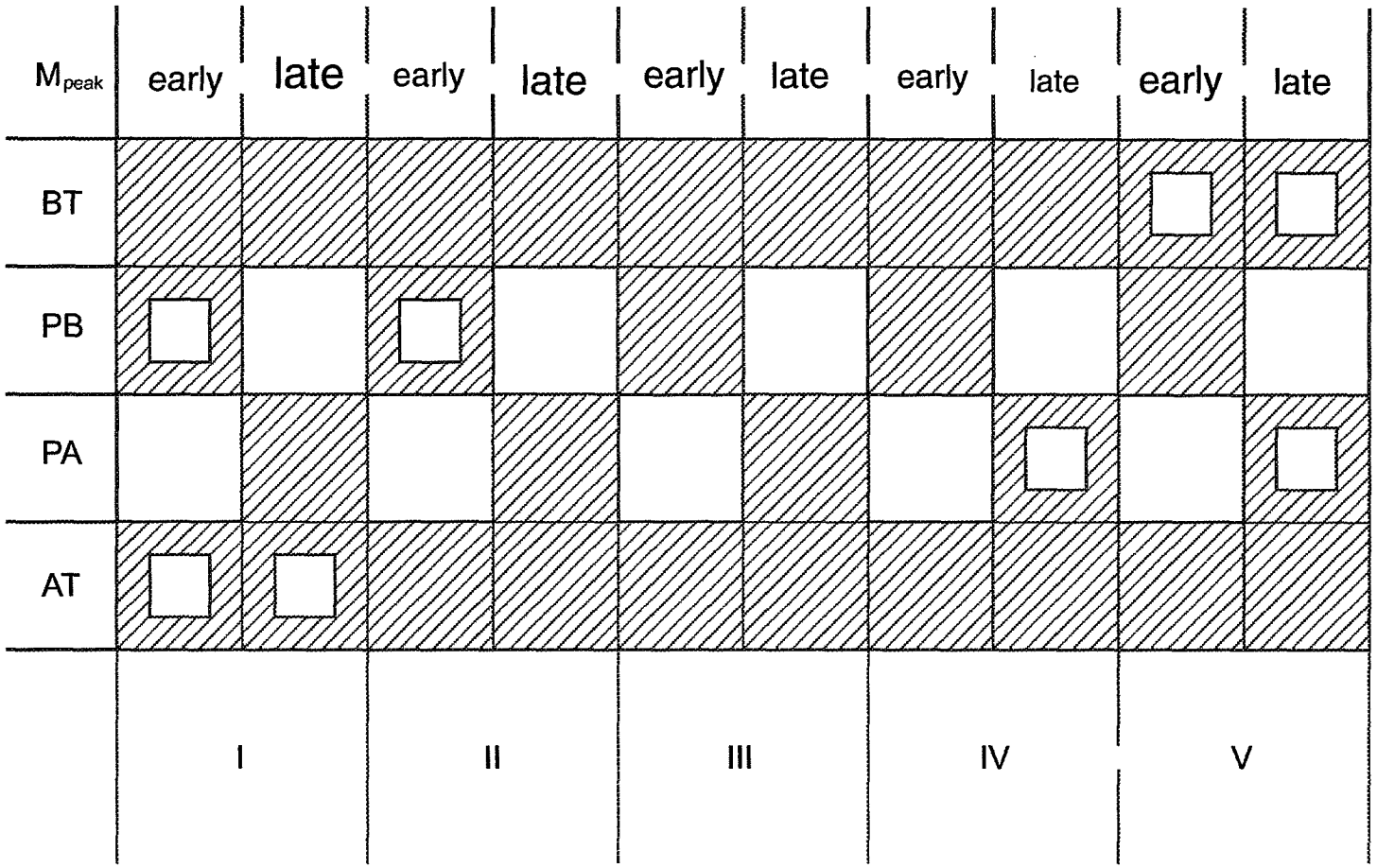
FIG. 22 is an illustration of the opening of the control edges as a function of the switching position in the CTA method.

FIG. 22 schematically shows, for the switching positions I-V, the degree of opening of the orifices 41, 43 as viewed from the respective inner edges PB, PA and outer edges BT, AT as a function of the switching positions I-V and the adjustment direction. Fully hatched fields correspond to a completely blocked orifice 41, 43, fully white fields correspond to a completely open orifice 41, 43, and partially hatched fields correspond to a partially blocked orifice 41, 43.

Figure 23:
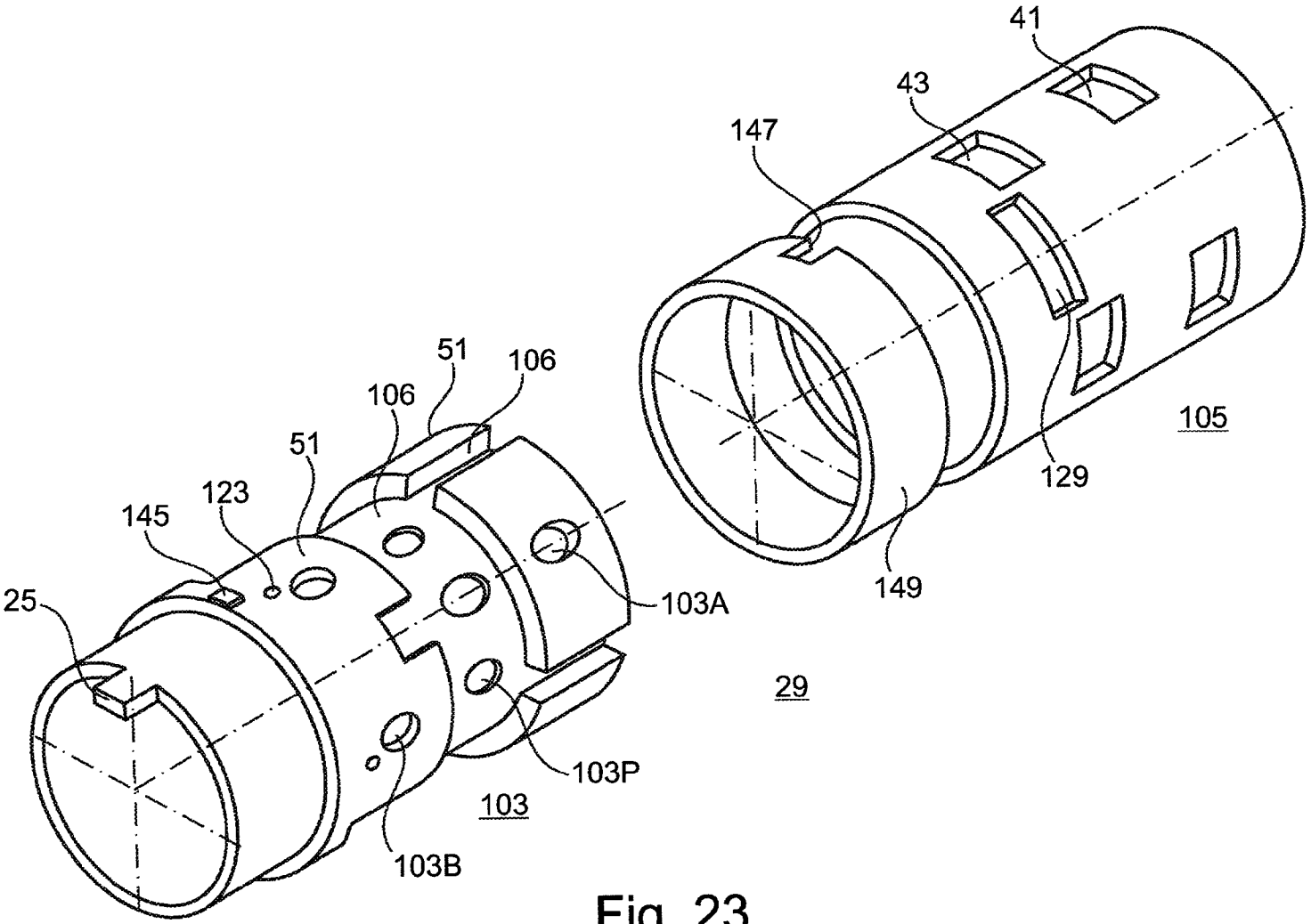
FIG. 23 shows a valve housing of a control valve in a double-sleeve embodiment in a perspective illustration.

The illustrations and examples up to this point related to a variant suitable in particular as a so-called central valve embodiment, that is to say a control valve for controlling the supply and discharge of pressure medium to and from the chamber parts is arranged centrally in a camshaft. Below, a variant will be illustrated in which the control valve is arranged outside the camshaft and interacts with a rotary transmitter which, together with the control valve and the camshaft, controls a control device 20 for controlling the supply and discharge of pressure medium to and from the chamber parts. Here, the rotary transmitter performs the function of adaptation to the respective camshaft torques, whereas the control valve sets the setting for advancement, retardation or holding. This may be realized for example by means of the following embodiments:

FIG. 23 shows a valve housing 29 which is constructed from an inner sleeve 103 and an outer sleeve 105. The inner sleeve 103 has, radially to the outside, an orifice cover 51 which forms a surface which, in the installed state, adjoins the inner side of the outer sleeve 105. The orifice cover 51 is made discontinuous by recesses 106. Inlet orifices 103P for the supply of pressure medium to a locking device 121 or for connecting the chamber parts A, B in a torque mode open into the recesses 106. Arranged in the orifice cover 51 are first outlet orifices 103A and second outlet orifices 103B which lead through the inner sleeve 103 into the hollow interior of the inner sleeve 103. Furthermore, locking orifices 123 lead through the inner sleeve 103.

Figure 34:
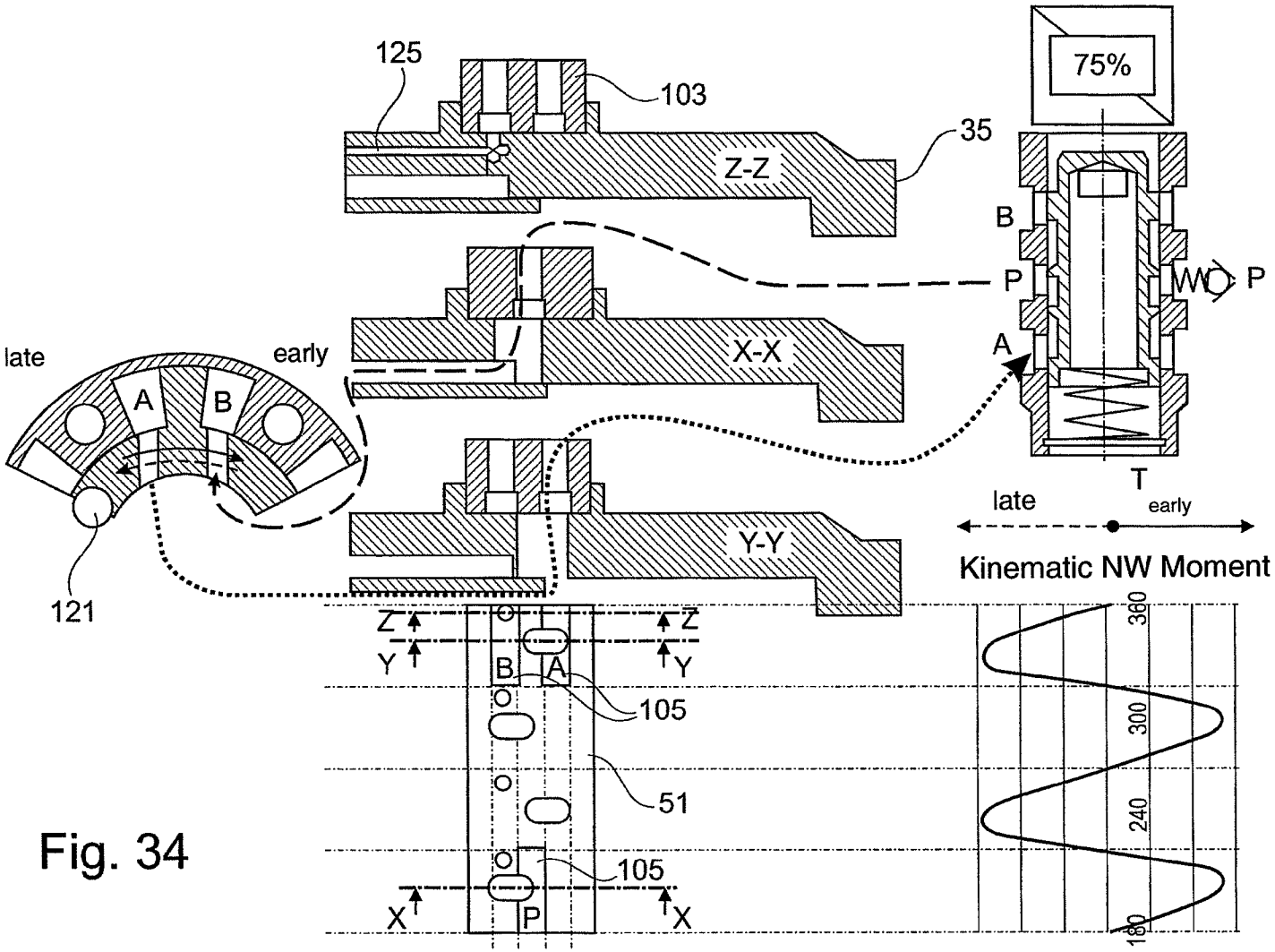
FIG. 34 shows a schematic illustration of the installation process.

At an axial end which, in the installed state, faces toward a magnet 21, a rotation prevention element 25 in the form of an axial projection is formed on the inner sleeve 103. Engagement of the rotation prevention element 25 into a rotation prevention means receptacle 153 (see FIG. 34) causes the inner sleeve 103 to be fixed against rotation. An installation lug 145 serves for engagement with an installation recess 147 on the outer sleeve 105 for the purpose of fixing the angular position of the inner sleeve 103 relative to the outer sleeve 105. After installation is complete, said fixing is released, such that the outer sleeve 105 is rotatable relative to the inner sleeve 103 (see FIG. 34). The outer sleeve 105 has first orifices 41, which communicate with the first chamber parts A, and second orifices 43, which communicate with the second chamber parts B. Furthermore, in the outer sleeve there are provided locking windows 129 by means of which the supply of pressure medium to a locking device 121 can be controlled, as will be explained further below.

Figure 24:
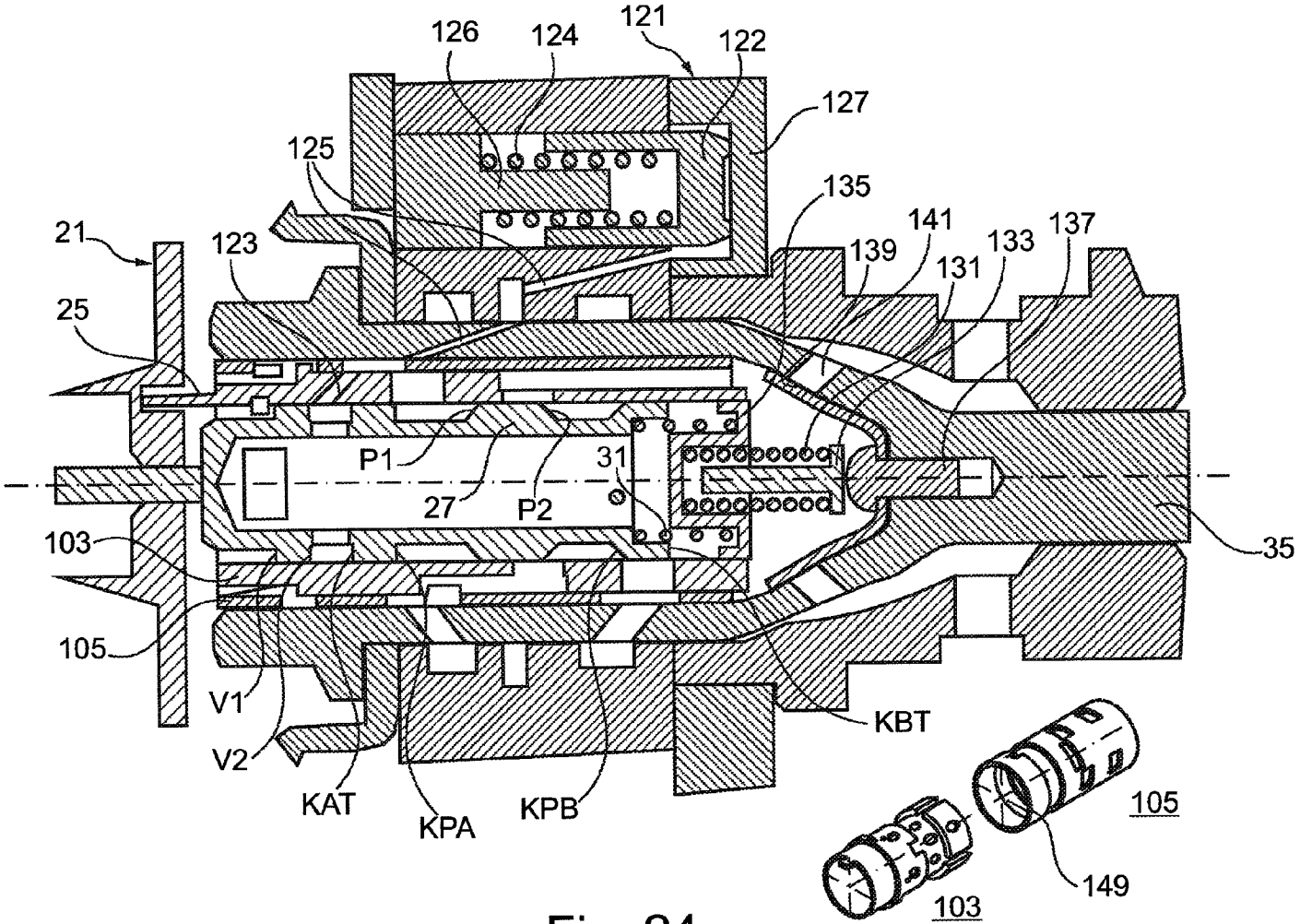
FIG. 24 shows a longitudinal section through a control device, which is arranged in a camshaft, with a locking device.

FIG. 24 shows the installed state in a longitudinal section. A locking device 121 in the camshaft adjuster 11 comprises a locking pin 122, a locking spring 124, a locking guide 126 and a locking slot 127 formed in the stator 65. In an unpressurized state, the locking spring 124 arranged on the locking guide 126 presses the locking pin 122 into the locking slot 127, as a result of which an adjustment is blocked. If pressure medium is conducted to the locking pin 122 via a locking feed line 125, said pressure medium forces the locking pin 122 back counter to the locking spring 124, and an adjustment is permitted. Initially after an engine start, adequate pressure is still not available. Locking should therefore be maintained because otherwise rattling of the adjuster 11 would occur. Under some circumstances, however, an air column, for example, may lead already to undesired unlocking of the locking pin 122. To thus prevent an undesired unlocking, a description is given further below of how an unlocking is prevented until an advance adjustment takes place for the first time.

A magnet 21 serves for axial adjustment of a valve piston 27 in the axial direction, to the right in the Figure. A restoring movement is effected by means of a restoring spring 31. The restoring spring 31 is supported in a mounting sleeve 135 which, on the opposite side, is itself supported by a mounting spring 131. A mounting piston 133 is held in the mounting spring 131. This mounting piston bears with a flat head against a mounting pin 137 which is in turn screwed into the camshaft 35. During operation, the valve piston 27, its restoring spring 31, the mounting sleeve 135, the mounting spring 131 and the mounting piston 133 are fixed in terms of rotation, while the mounting pin 137 rotates with the camshaft 35. The mounting pin 137 has a rounded head against which the mounting piston 133 bears. This results in approximately punctiform contact with low friction. The mounting pin 137 also serves to fix a check valve 139 which is formed as a sheet-metal flap and by means of which a supply orifice 141 through which pressure medium can be supplied can be closed off.

The valve piston 27 has control edges KAT, KPA, KBT, KPB which are formed by two radial projections and by means of which the outflow and inflow from and to the chamber parts A, B can be regulated. Two further radial projections form the control edges V1, V2, P1, P2. In relation to valve designs in the prior art by means of which conventional hydraulic control of a camshaft adjustment is realized, the present design has in particular the special feature of the additional control edges P1, P2 and V1, V2, the latter serving for the supply to the locking device 121. In interaction with the first and second orifices 41, 43 in the camshaft 35 and the orifice cover 51, it is now possible to set different switching positions as a function of the engine operating state, in particular of the engine oil pressure and of the magnitude of the camshaft torques. This will be explained in more detail on the basis of the following Figures.

Corresponding to the illustration in FIGS. 4-14, FIGS. 25-35 show the various switching positions for the pump mode or torque mode, in the case of retardation adjustment, advance adjustment and in the case of the respective occurrence of a retardation torque or advance torque. In the upper region, the longitudinal section from FIG. 24 is illustrated. The axial position of the valve piston 27 of the control valve 101 is determined by a magnet 21. Here, a percentage indicates the degree of energization of the electromagnet 21, and therefore the degree of axial displacement of the valve piston 27. Below, 5 switching positions are illustrated, at 100%, 75%, 50%, 25% and 0% energization. Other values for the energization may self-evidently also be possible here. Below the longitudinal section, on the left, the stator 63 and rotor 65 of a camshaft adjuster 11 with chamber parts A, B are depicted schematically, as in earlier Figures. Below this, the inner sleeve 103 and outer sleeve 105 are illustrated schematically in a circumferentially developed view, illustrating the overlap of the orifice cover 51 with the first and second orifices 41, 43. In a synchronous illustration to the right thereof there is depicted the profile of the camshaft torques and the alignment thereof in the advance or retardation directions.

Figure 25:
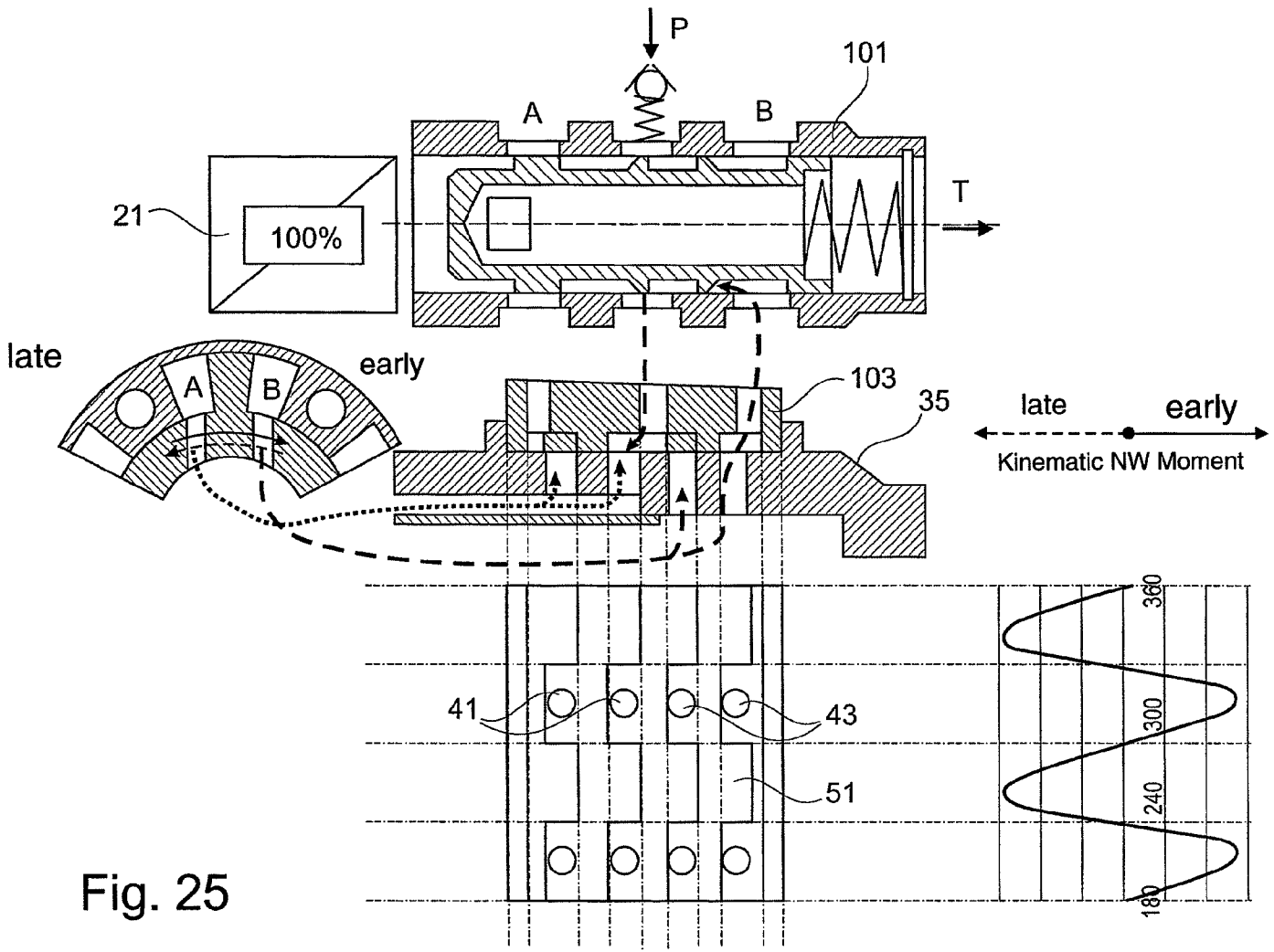
FIGS. 25-33 show a schematic illustration of the different switching positions for the pump and torque modes.
Figure 26:
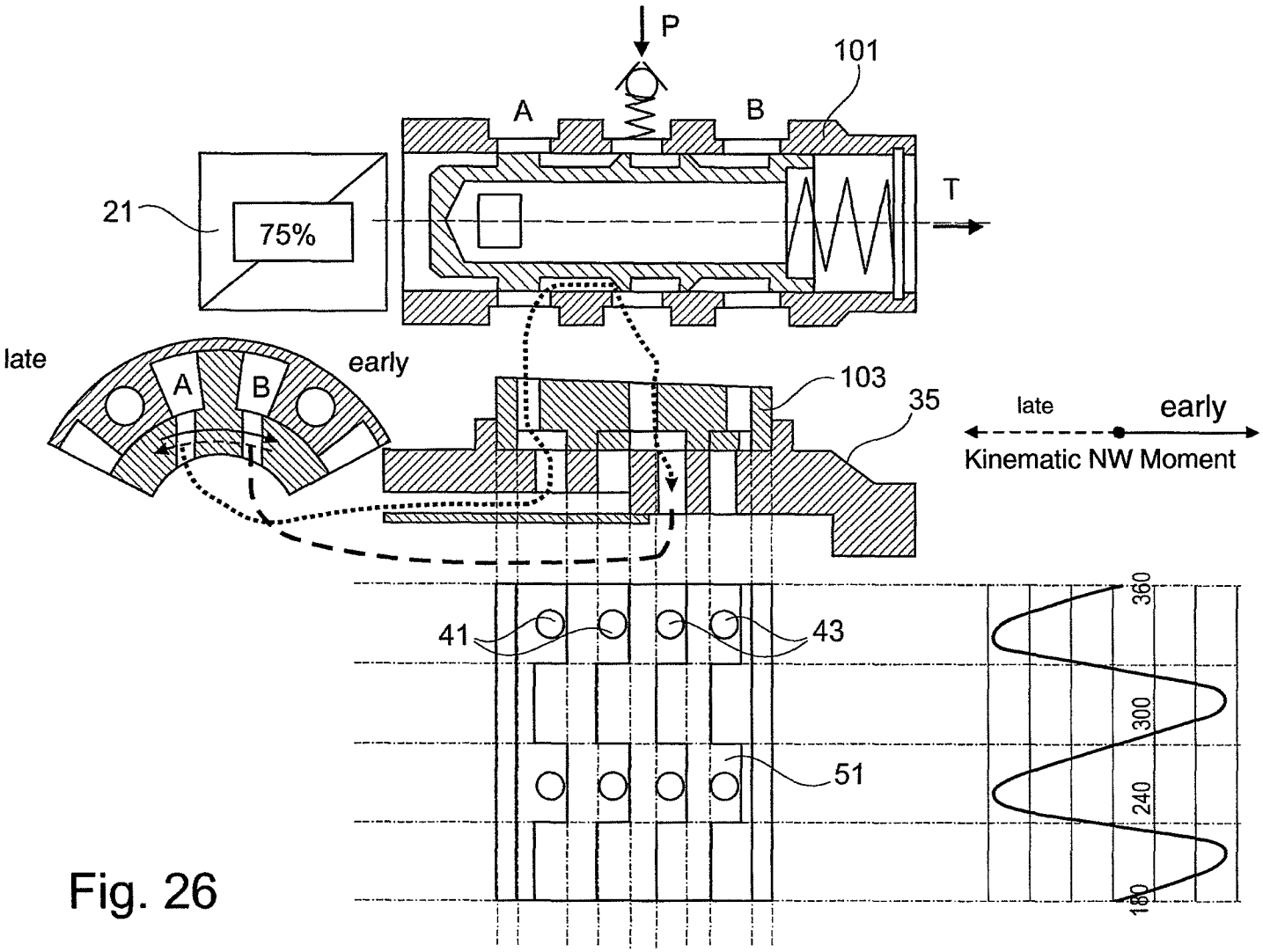

FIG. 25 now shows a first switching position in the case of 0% energization of the electromagnet 21 and therefore in a first axial position of the valve piston 27. This switching position corresponds to an adjustment in the retardation direction, wherein corresponding to the relative rotational position of the rotary transmitter 103 and of the camshaft 35, an angular position for a camshaft torque in the retardation direction is set. The dashed and dotted lines schematically show the flow directions of the pressure medium. Pressure medium passes via the cutouts 106 in the inner sleeve 103 via the second orifices 43 into the second chamber part B. At the same time, pressure medium is conducted via the outlet orifice 103A for the first chamber part A and via the first orifices 41 to the tank. Here, the cross sections of the orifices opened up are large, that is to say intense dethrottling is attained. This firstly prevents a damaging induction of air, and secondly permits a fast adjustment. FIG. 26 shows an image corresponding to FIG. 24, but the rotational position of the camshaft 35 has now changed such that an advance torque arises. In contrast to the retardation torque, which in FIG. 24 assists the retardation adjustment direction, the advance torque leads to a force directed counter to the desired adjustment, and therefore to a retardation. This is suppressed by virtue of the outlet from the second chamber part B now being closed off, and therefore no adjustment being possible, because no pressure medium can be displaced out of the chamber part B.

The switching position of FIGS. 24 and 25 thus corresponds to a retardation adjustment, specifically in the pump mode, because predominantly the pressure of the pressure medium provided by a pump P is utilized for adjustment. However, should an operating state arise in which the pressure is low and is not sufficient for a fast adjustment, the valve piston 27 can be moved into its next axial position in which the torque mode for a retardation is set. This will be explained on the basis of FIGS. 27 and 28.

Figure 27:
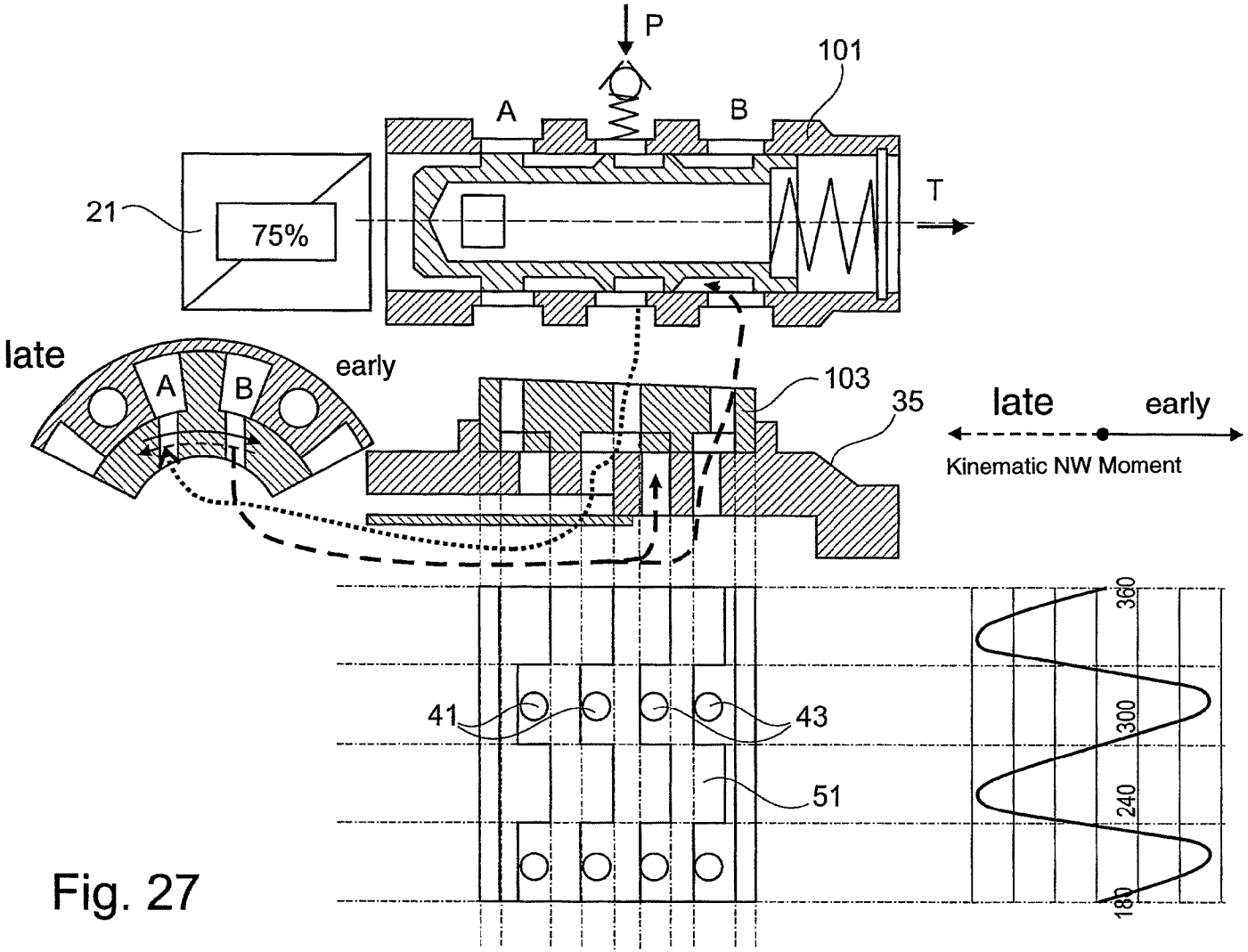
Figure 28:
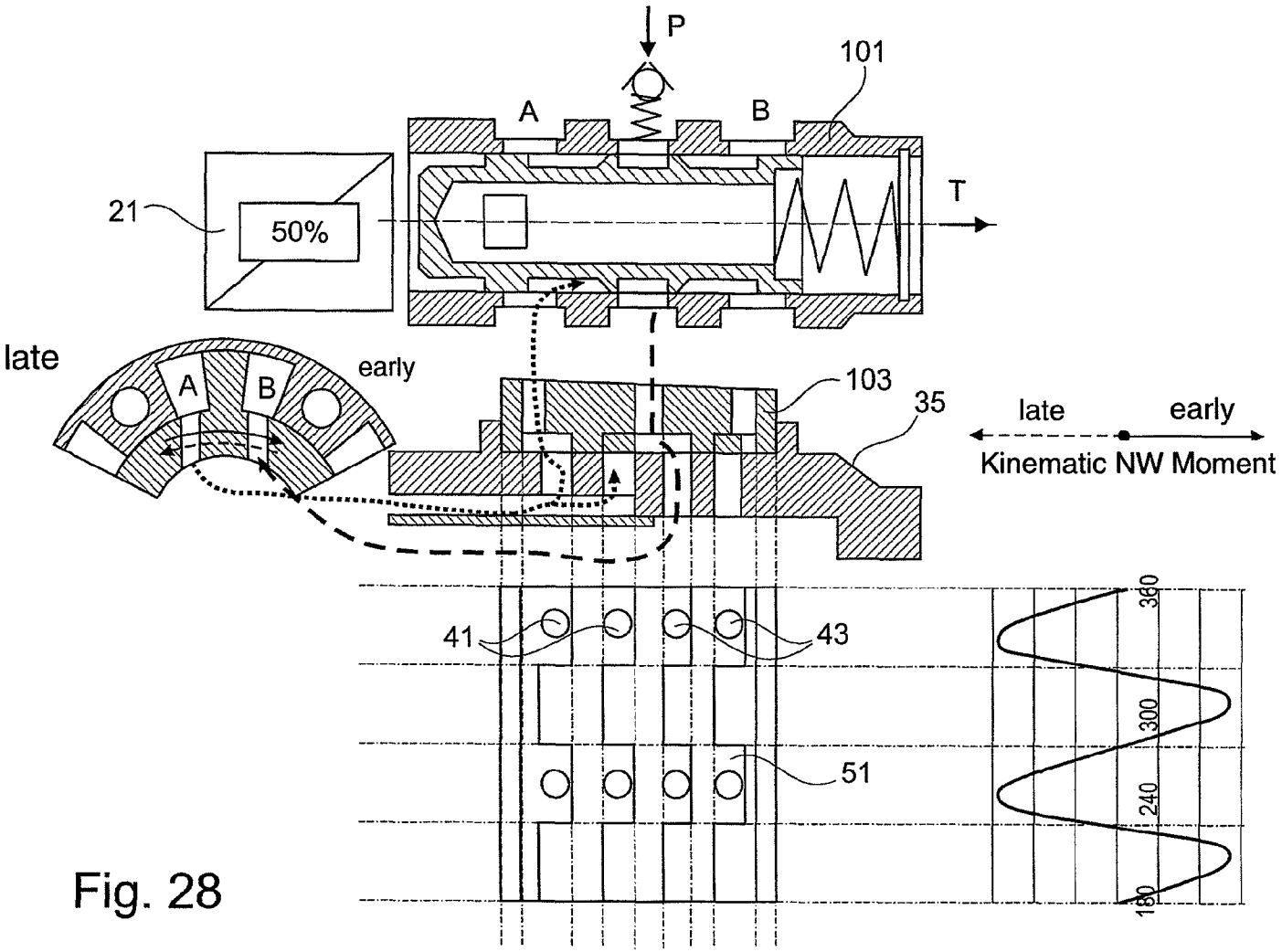

FIGS. 27 and 28 show an image corresponding to FIGS. 25 and 26, wherein now the electromagnet is 25% energized and the valve piston 27 therefore assumes a new axial switching position in the direction away from the magnet 21. Said switching position likewise effects a retardation. Now, however, upon the occurrence of a retardation torque, the chamber parts A, B are connected, such that pressure is built up in the first chamber part A by the retardation torque, as a result of which pressure medium is displaced from the first chamber part A into the second chamber part B. This leads to the desired adjustment. Upon the occurrence of an advance torque, however, the outlet from the second chamber part B is again blocked, such that no adjustment can take place. FIG. 28 shows in this respect an image corresponding to FIG. 27, but now in the case of the occurence of an advance torque.

Figures 29, 29A, 29B, 29C:
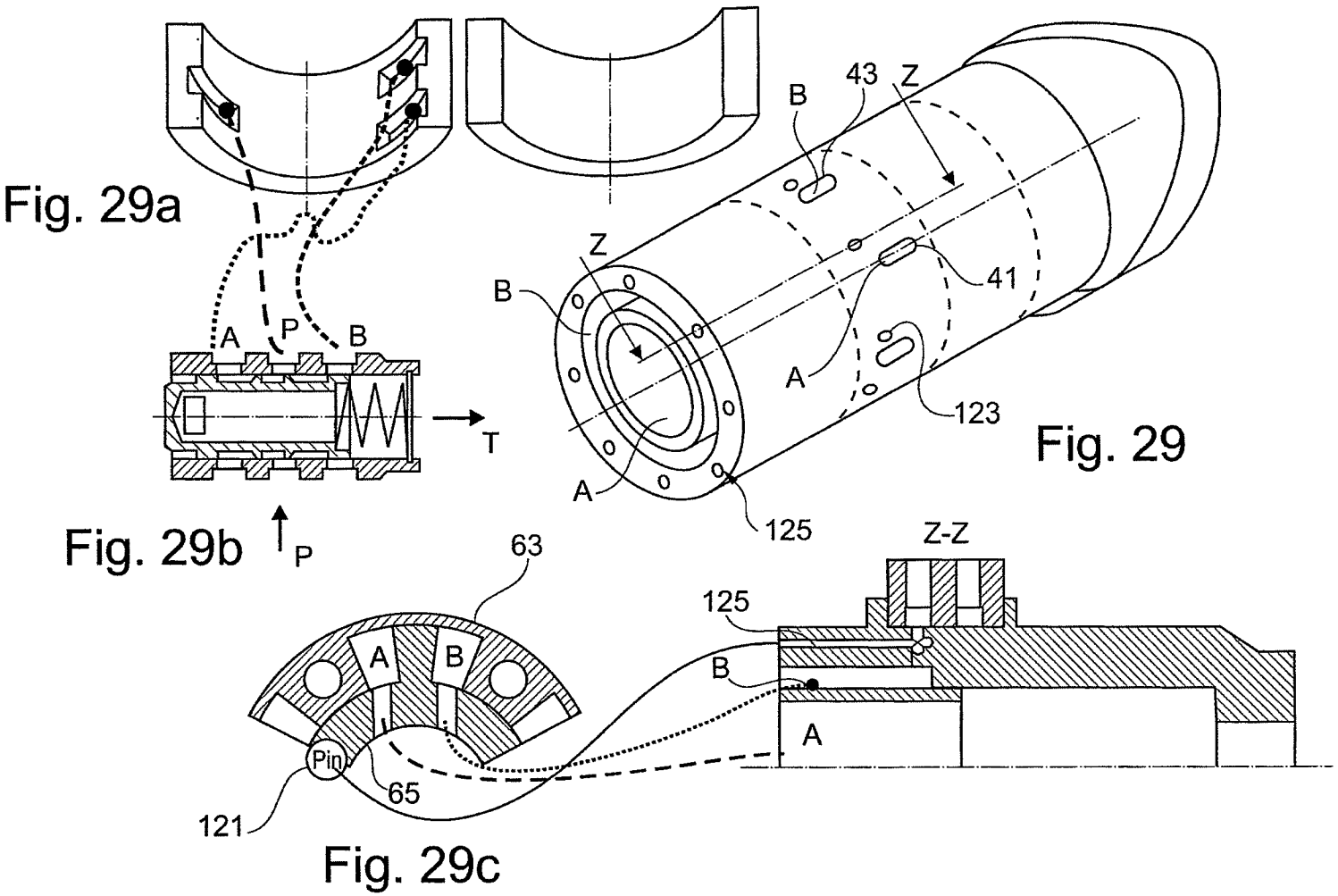

FIG. 29 shows a switching position in the case of 50% energization of the electromagnet 21. In said switching position, the angular position of the camshaft 35 is held, that is to say no adjustment takes place. This is achieved in that, upon the occurrence of a retardation torque, an outlet from the first chamber part A is blocked, as illustrated in FIG. 29. Upon the occurrence of an advance torque, not illustrated, the first and second orifices 41, 43 would again come to rest in a position in which an outlet out of the second chamber part B is blocked, such that in this case, too, no adjustment is possible.

Corresponding to FIGS. 25-28, in the case of a switching position of 75% energization, a torque mode can be set for an advance, and in the case of a switching position of 0%, a pump mode can be set for an advance, with correspondingly interchanged opening-up or blocking of the orifices. This is illustrated in FIGS. 30-33. Through simple selection of the axial position of the valve piston 27, it is thus possible for the first time to select a pump mode or a torque mode, that is to say an OPA method or a CTA method, for the adjustment as a function of the operating state of the internal combustion engine. Through said adaptability, particularly fast adjustment is thus achieved overall. In addition to this there is the intense dethrottling in each case, which likewise ensures a fast adjustment and additionally prevents an induction of air.

Figure 30:
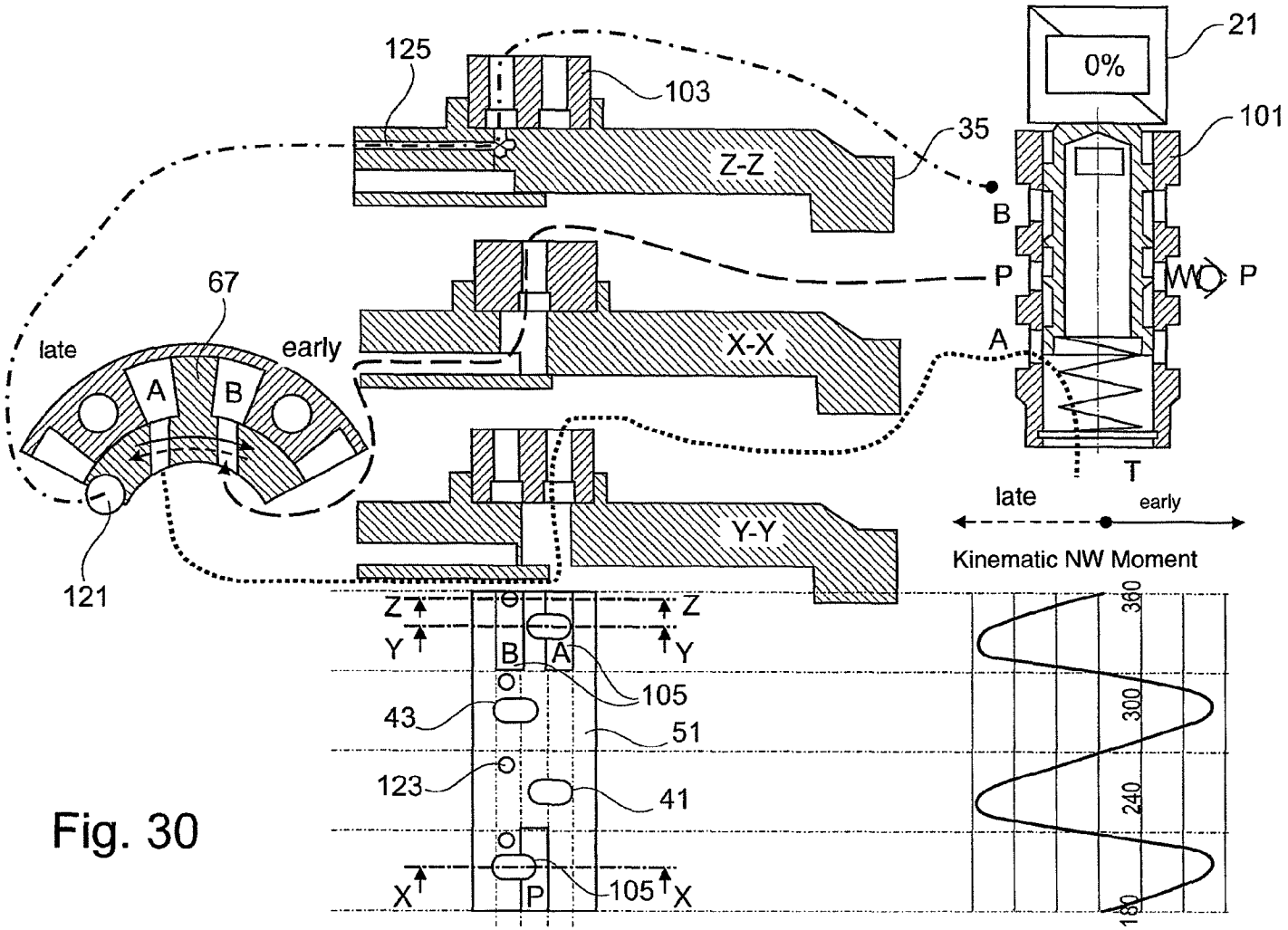
Figure 31:
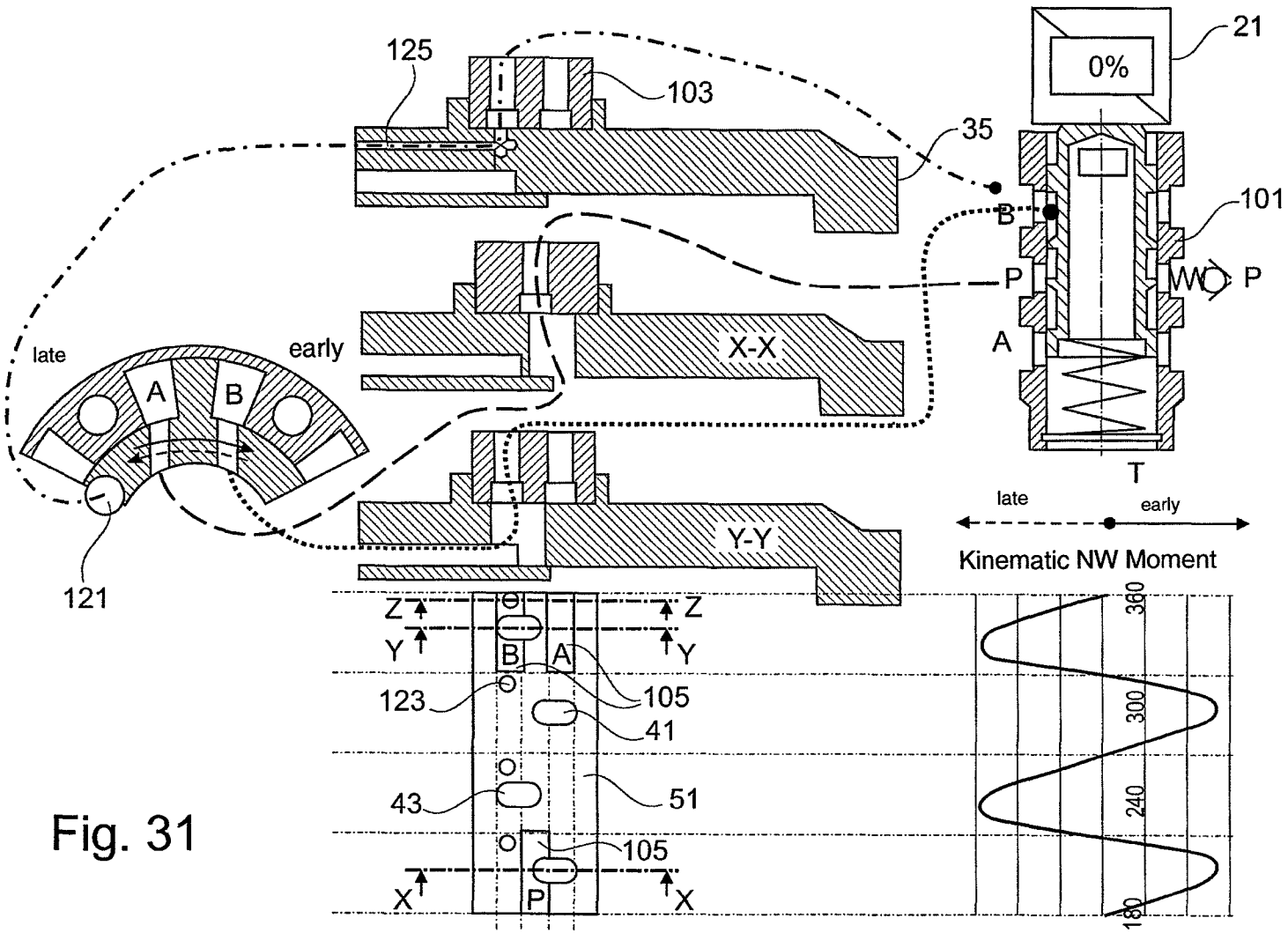
Figure 32:
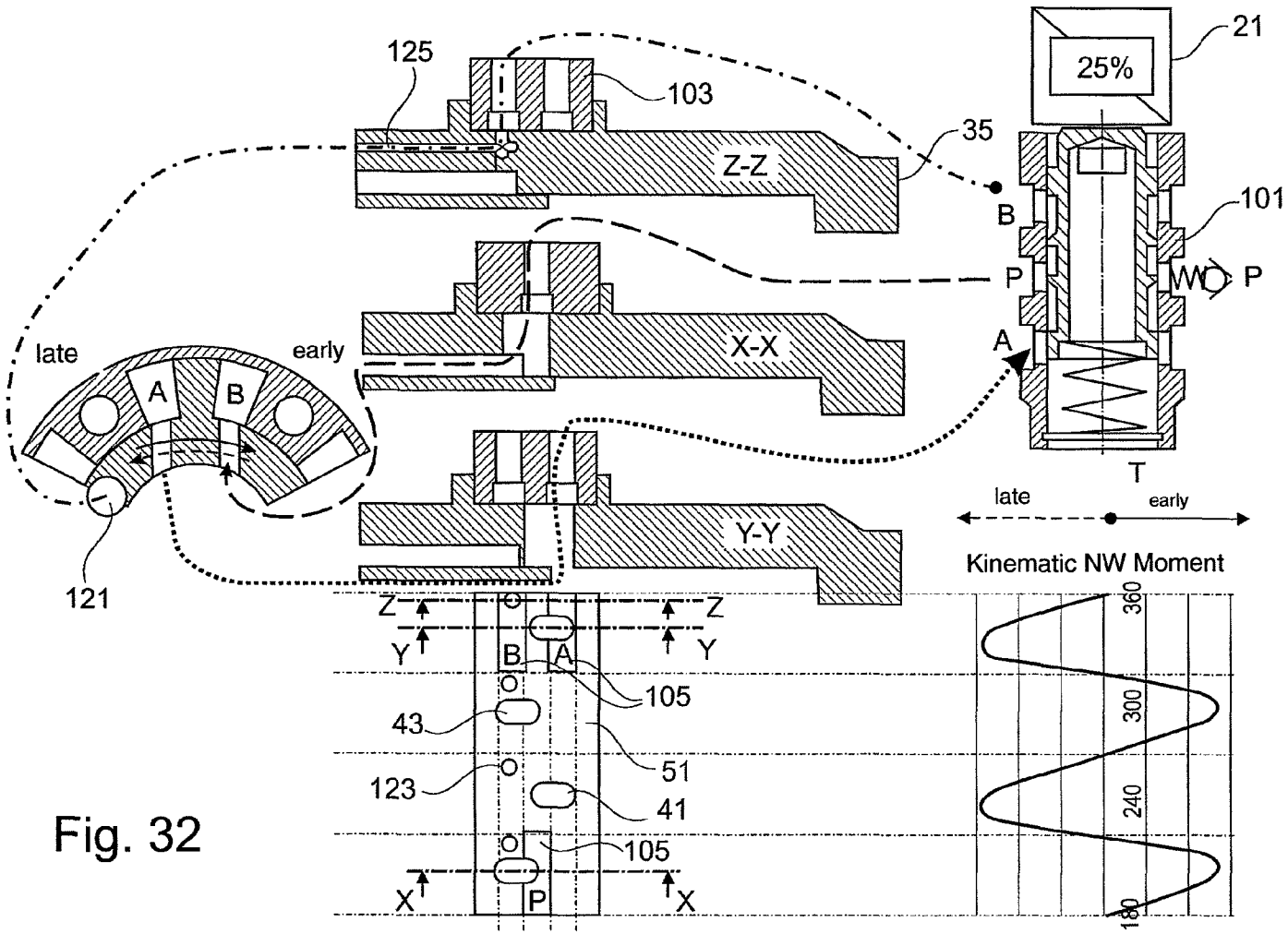
Figure 33:
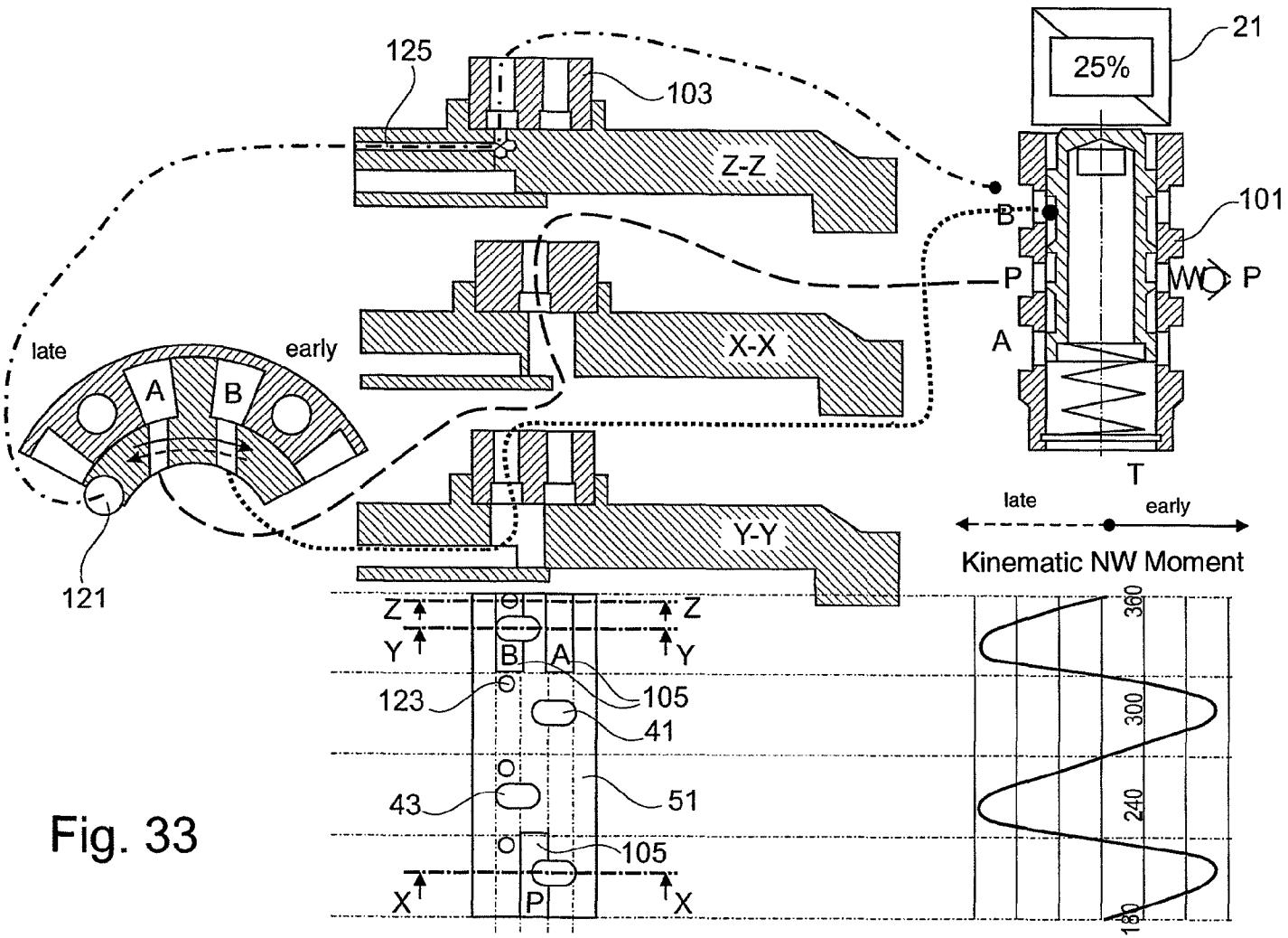

It can also be seen from FIGS. 25-33 that pressure medium is supplied to the locking device 121 for the first time when an advance adjustment takes place. In the case of a locked state, that is to say for example after a cold start of the engine, this means that the locking device 121 remains locked until the first early adjustment takes place. This is realized by the corresponding connection of the locking feed line 125 to the locking orifice 123. In retardation switching positions and also in the adjustment-free central position, the locking feed line either continues to be ventilated in an unpressurized manner to the tank, or completely shut off, via the locking orifice 123. Only in an advance switching position, see FIG. 30, is the locking pin 122 subjected to pressure, and unlocked, by pressure medium supplied via the locking orifice 123 and the locking feed line 125. In the normal operating state, the locking pin 122 remains unlocked, because the locking slot 127 does not correspond to the locking pin 122.

Figure 35:
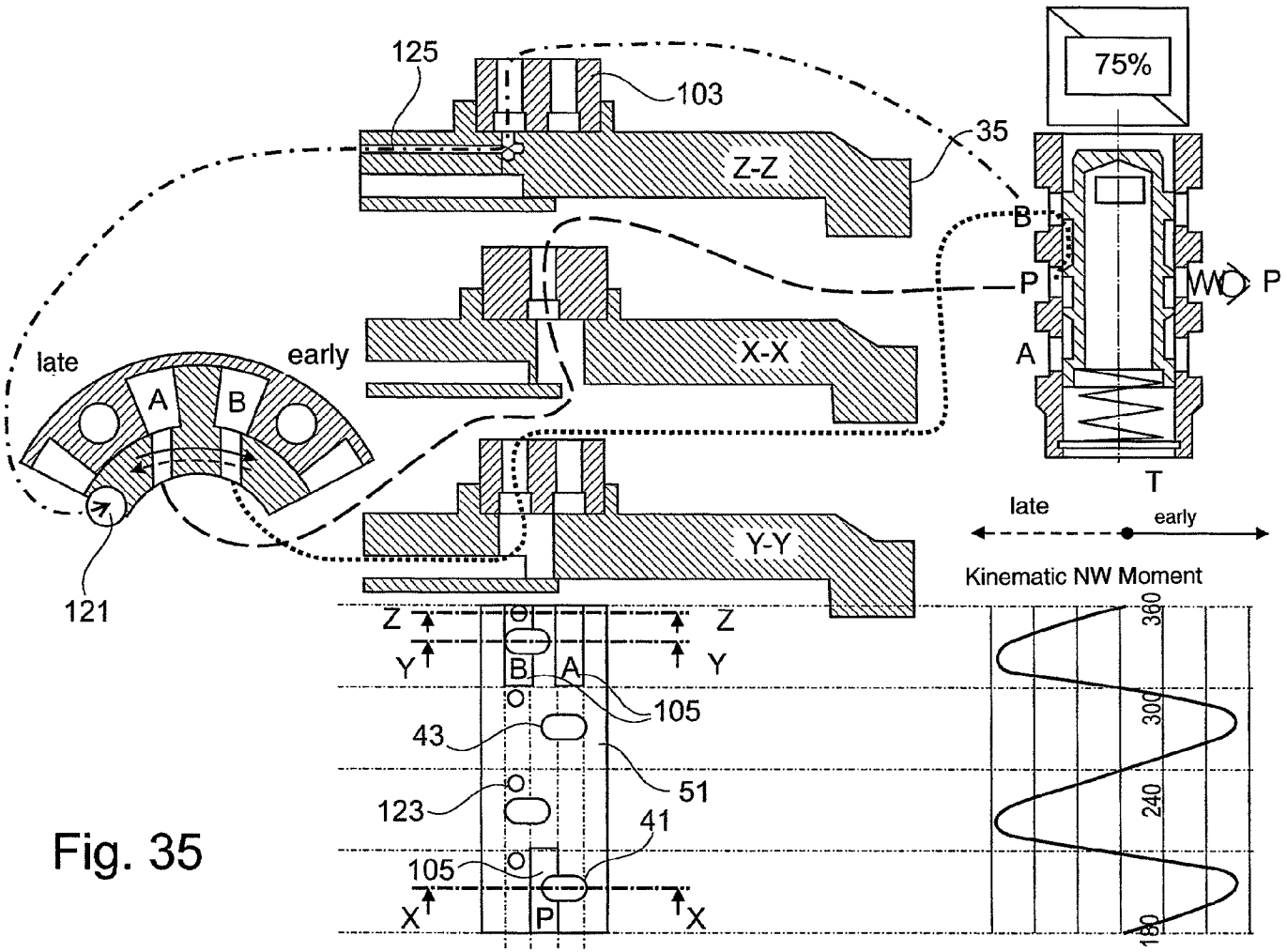
FIG. 35 shows a hydraulic circuit diagram.

The five axial switching positions and the camshaft-torque-dependent rotational position can be summarized in a hydraulic circuit diagram shown in FIG. 35. Schematically shown is the control valve 101, with the axial positions of the valve piston 27 on the one hand and the two relative rotational positions D1, D2 of the inner sleeve 103 and the outer sleeve 105 on the other hand. Five switching positions of the valve piston 27, corresponding to the various levels of energization of the magnet 21 are illustrated in five squares adjacent to one another. The orifices to the pump P and outlet to the tank T are fixed and can be occupied by the various connections, illustrated by arrows, or closures, illustrated graphically in a "T" shape, by virtue of the corresponding square of the desired switching position being moved to the ports. The coupling to the camshaft torques is depicted by the guidance of a guide pin 157 in a rectangular-waveform guide groove 159, and the guide pin 157 activates the first or second rotational position D1, D2 as a function of the occurrence of an advance torque or retardation torque. The guide pin 157 and guide groove 159 are thus fictitious and serve merely for illustration. The two rotational positions D1, D2 are illustrated in two mutually adjacent rectangles, and are transformed into an axial displacement in order to be able to better depict the switching logic. Here, too, arrows show the ports connected to one another in each case. The image thus shows specifically an occurrence of an advance torque (guide pin 157 in a right-hand groove part of the guide groove 159) and a retardation adjustment in the pump mode. An outflow from the second chamber part B is blocked, that is to say no adjustment takes place. Upon the occurrence of a retardation torque, the rotational position D2 would be activated, as a result of which pressure is passed to the second chamber part B, and at the same time the first chamber part A is open to the tank. A retardation adjustment then takes place.

LIST OF REFERENCE SYMBOLS

1 Internal combustion engine
2 Crankshaft
3 Piston
4 Cylinder
5 Traction mechanism drive
6 Intake camshaft
7 Exhaust camshaft
8 Cam
9 Intake gas exchange valve
10 Exhaust gas exchange valve
11 Camshaft adjuster
12 Cylinder valve
20 Control device
21 Magnet
23 Magnet piston
25 Rotation prevention element
27 Valve piston
29 Valve housing
31 Restoring spring
33 Axial bearing arrangement
35 Camshaft
41 First orifices
43 Second orifices
45 Third orifices
51 Orifice cover
51A First cover part
51B Second cover part
52 Crown serrations
53 Valve piston surface
63 Stator
65 Rotor
67 Vane
69 Pressure chamber
71 First oil duct
73 Second oil duct
101 Control valve
103 Inner sleeve
103P Inlet orifices
103A Outlet orifice, first chamber part
103B Outlet orifice, second chamber part
105 Outer sleeve
106 Cutouts
121 Locking mechanism
122 Locking pin
123 Locking orifice
124 Locking spring
125 Locking feed line
126 Locking guide
127 Locking slot
129 Locking window
131 Mounting spring
133 Mounting piston
135 Mounting sleeve
137 Mounting pin
139 Check valve
141 Supply orifice
145 Installation lug
147 Installation recess
149 Installation ring
151 Slot
153 Rotation prevention means receptacle
157 Guide pin
159 Guide groove
A First chamber part
B Second chamber part
P Pressure medium pump
T Tank
PA Inner edge of the second cover part 51B
PB Inner edge of the first cover part 51A
AT Outer edge of the second cover part 51B
BT Outer edge of the first cover part 51A
P1, P2 Pump control edges
V1, V2 Locking control edges
KAT, KPA, KBT, KBA Chamber part control edges
D1, D2 Rotary positions

The invention claimed is:

1. A camshaft adjuster for a camshaft which serves to actuate cylinder valves of an internal combustion engine, wherein retardation torques in a direction of retarded cylinder valve opening times are imparted back to the camshaft adjuster by the camshaft when cams are running on, and oppositely directed advance torques in a direction of advanced cylinder valve opening times are imparted back to the camshaft adjuster by the camshaft when cams are running off, the camshaft adjuster comprising:

a pressure chamber and an adjusting element arranged in the pressure chamber, wherein the adjusting element divides the pressure chamber into a first chamber part A and a second chamber part B, wherein pressure medium can be supplied to the first chamber part A and the second chamber part B and pressure medium can be discharged from the first chamber part A and second chamber part B, such that the adjusting element is movable by a pressure difference between the first chamber part A and second chamber part B, resulting in a rotation of the camshaft, wherein, when a relatively high pressure prevails in the first chamber part A, the camshaft is rotated in the direction of advanced cylinder valve opening times, and when a relatively high pressure prevails in the second chamber part B, the camshaft is rotated in the direction of retarded cylinder valve opening times, and wherein the supply and discharge of pressure medium is controlled by a control device, the control device includes a control valve which is positioned centrally in the camshaft and has a valve piston that is guidable in a valve housing, the valve housing has an inner sleeve and an outer sleeve which is radially outside and surrounds the inner sleeve, and the inner sleeve is fixed against rotational movement by a rotation prevention element, while the outer sleeve is rotatable, a torque mode or a pump mode is selectively settable by the control device, wherein in the torque mode, predominantly camshaft torques are utilized to build up pressure in the first chamber part A or in the second chamber part B, whereas in the pump mode, the pressure build-up in the first chamber part A or in the second chamber part B is realized predominantly by pressure medium provided by a pressure medium pump P.

2. The camshaft adjuster as claimed in claim 1, wherein an orifice cover is formed on an outer side of the inner sleeve, and in the outer sleeve there are formed first orifices, which communicate with the first chamber part A, and second orifices, which communicate with the second chamber part B, wherein the first orifices and the second orifices are opened up or closed off by the orifice cover in accordance with a rotational angle position of the inner sleeve with respect to the outer sleeve.

3. The camshaft adjuster as claimed in claim 1, wherein the pump mode or the torque mode can be set by an axial displacement of the valve piston.

4. The camshaft adjuster as claimed in claim 3, wherein the valve piston is axially displaceable by an electromagnet, wherein the electromagnet presses the valve piston against a restoring spring which can effect a restoring movement of the valve piston, the restoring spring is supported in a mounting sleeve and at the same time a mounting spring is provided which, oppositely with respect to the restoring spring, is supported at one side in a bearing sleeve and at the other side on the camshaft.

5. The camshaft adjuster as claimed in claim 4, wherein the mounting spring supports a mounting piston which is supported in approximately punctiform manner on a mounting pin which is connected to the camshaft.

6. The camshaft adjuster as claimed in claim 1, wherein, for a relative axial position of the valve piston, five switching positions can be set, wherein in a first position, the pump mode is set for an adjustment of the camshaft in the direction of retarded cylinder valve opening times, in a second, axially subsequent switching position, the torque mode is set for an adjustment of the camshaft in the direction of retarded cylinder valve opening times, in a third, axially subsequent switching position, a camshaft adjustment is blocked, in a fourth, axially subsequent switching position, the torque mode is set for an adjustment of the camshaft in the direction of advanced cylinder valve opening times, and in a fifth, axially subsequent switching position, the pump mode is set for an adjustment of the camshaft in the direction of advanced cylinder valve opening times.

7. The camshaft adjuster as claimed in claim 3, wherein a locking mechanism is provided by which the camshaft adjuster is mechanically blocked in a locking position so as to be prevented from being adjusted, the locking mechanism is hydraulically unlockable by the pressure medium, and a supply of pressure medium to the locking mechanism is connected such that the locking mechanism unlocks only when the valve piston is in an axial switching position which corresponds to an adjustment in the direction of advanced cylinder valve opening times.

8. The camshaft adjuster as claimed in claim 4, wherein, during installation of the control valve in the camshaft, the inner sleeve and the outer sleeve are displaced relative to one another such that a rotationally conjoint connection between the inner sleeve and the outer sleeve is released.

9. The camshaft adjuster as claimed in claim 8, wherein the rotation prevention element engages into a cutout of the electromagnet, and the inner sleeve can be displaced axially relative to the outer sleeve as a result of the installation of the electromagnet.

* * * * *